US010260230B2

(12) United States Patent
Rogers

(10) Patent No.: US 10,260,230 B2
(45) Date of Patent: Apr. 16, 2019

(54) CONNECTOR FOR USE IN FORMING JOINT

(71) Applicant: SRG IP PTY LTD, Subiaco, Western Australia (AU)

(72) Inventor: Lance Rogers, Subiaco (AU)

( * ) Notice: Subject to any disclaimer, the term of this patent is extended or adjusted under 35 U.S.C. 154(b) by 0 days.

(21) Appl. No.: 15/116,984

(22) PCT Filed: Feb. 6, 2015

(86) PCT No.: PCT/AU2015/000064
§ 371 (c)(1),
(2) Date: Aug. 5, 2016

(87) PCT Pub. No.: WO2015/117190
PCT Pub. Date: Aug. 13, 2015

(65) Prior Publication Data

US 2017/0175382 A1 Jun. 22, 2017

(30) Foreign Application Priority Data

Feb. 6, 2014 (AU) ..... 2014900352

(51) Int. Cl.
*E04B 1/41* (2006.01)
*E04C 5/08* (2006.01)
(Continued)

(52) U.S. Cl.
CPC ..... *E04B 1/4114* (2013.01); *E04B 1/483* (2013.01); *E04C 5/08* (2013.01); *E04C 5/12* (2013.01); *E04C 5/16* (2013.01); *E04C 5/10* (2013.01)

(58) Field of Classification Search
CPC . E04C 5/08; E04C 5/16; E04B 1/4107; E04B 1/4114; E04B 1/483
See application file for complete search history.

(56) References Cited

U.S. PATENT DOCUMENTS 2,577,997 A 12/1951 Carter
2,590,933 A * 4/1952 Carter ..... E01C 11/14 404/59

(Continued)

FOREIGN PATENT DOCUMENTS

DE 3801121 A1 9/1988
JP 2008-38437 A 2/2008

OTHER PUBLICATIONS

International Search Report and Written Opinion (PCT/AU2015/000064).

*Primary Examiner* — Paola Agudelo
(74) *Attorney, Agent, or Firm* — Tysver Beck Evans, PLLC

(57) ABSTRACT

Connector (10) forming a joint between first (20) and second (22) surfaces. Connector (10) comprises: (i) hollow male member (18) to be embedded in first surface (20), the male member (18) having open ended protrusion (102) extending therefrom; (ii) a hollow female member (12) to be embedded in second surface (22), female member (12) having mating opening (42*a*) for receiving protrusion (102); and (iii) flexible sealing means (16) for forming a fluid tight seal between the female (12) and male (18) members. When installed, tendon (34) forming part of the first surface (20) extends through protrusion (102) into female member (12). Prior to grouting, movement of tendon (34) during settling of first surface (20) is facilitated by the male and female member (12, 18) without breaking the fluid tight seal formed by flexible sealing means (16). Also claimed is forming a joint between a vertical surface and a horizontal surface.

40 Claims, 24 Drawing Sheets

(51) Int. Cl.

| | |
|---|---|
| ***E04C 5/10*** | (2006.01) |
| ***E04B 1/48*** | (2006.01) |
| ***E04C 5/12*** | (2006.01) |
| ***E04C 5/16*** | (2006.01) |

(56) References Cited

U.S. PATENT DOCUMENTS 3,000,146 A * 9/1961 Rogers ..... E04B 1/4114 52/243
3,678,644 A * 7/1972 Wakefield ..... E04B 1/04 264/261
4,298,206 A 11/1981 Kojima
4,648,739 A 3/1987 Thomsen
5,272,851 A * 12/1993 De La Fuente ..... E01C 7/16 52/223.13
6,151,850 A * 11/2000 Sorkin ..... E04C 5/08 52/223.1
6,176,051 B1 * 1/2001 Sorkin ..... E04C 5/08 403/305
6,216,403 B1 4/2001 Belbeoch'h
7,003,921 B2 * 2/2006 Hisano ..... E04C 5/165 52/223.11
8,650,820 B2 * 2/2014 Bocquet ..... E04B 1/2604 52/223.8
9,062,457 B2 * 6/2015 Gilling ..... E04C 5/165
2002/0157333 A1 * 10/2002 Kadotani ..... E04C 5/08 52/223.2
2005/0097843 A1 * 5/2005 Giesel ..... E04C 5/08 52/223.1
2010/0239366 A1 9/2010 Bahr et al.
2011/0011024 A1 * 1/2011 Pellicer ..... B28B 5/04 52/583.1
2014/0331581 A1 * 11/2014 Larkin ..... E04B 1/7608 52/223.14
2016/0305140 A1 * 10/2016 Wilson ..... E04G 23/0218

* cited by examiner

CONNECTOR FOR USE IN FORMING JOINT

FIELD OF THE INVENTION

The invention relates to a connector for use in forming joints. The invention is particularly suited for use in connecting portions of a post-tensioned concrete structure, such as floor slabs, in a manner that allows the portions to move relative to each other as occurs during settling of the portions.

BACKGROUND TO THE INVENTION

The following discussion of the background to the invention is intended to facilitate an understanding of the present invention. However, it should be appreciated that the discussion is not an acknowledgment or admission that any of the material referred to was published, known or part of the common general knowledge in any jurisdiction as at the priority date of the application.

Post-tensioning ("PT") is a technique used in the construction of buildings, particularly those where the floors of the building are intended to have long spans uninterrupted by vertical pillars. PT involves reinforcing (strengthening) concrete or other materials with high strength steel strands or bars. These strands and bars are generally referred to as tendons.

The problem with this approach is that it is generally not possible to pour an entire floor as a single floor plate due to size restriction, continuity requirements and/or restraint conditions. As a consequence, the floor is commonly formed in sections or individual slabs. These sections or slabs are commonly poured at different time to each other. To ensure that the floor is more or less continuous, each section or slab contains suitable tendons such as PT wire cables or PT strand cables.

As each section or slab cures and settles, the sections or slabs may move relative to each other. This means that the joint connecting the sections or slabs must be capable of accommodating this relative movement. At the same time, the joint operates to allow temporary release of restraining effects of the various sections relative to one another and thus ensure that the maximum amount of PT pre-compression force is transferred into the floor plates. If insufficient PT pre-compression force is transferred into the floor plates there exists the possibility of cracking within the sections or slabs—thereby reducing the longevity and the integrity of the resulting floor plate.

One past method of allowing for such movement and transfer of pre-compression force has been to place temporary movement joints at strategic locations within the building. Each temporary movement joint allows for movement during curing and settling of the structural elements that it joins. Once the joined structural elements have cured and settled, the temporary movement joint is permanently locked so as to provide a more or less continuous floor or other element of the building.

While this approach works, almost all temporary movement joints of the prior art suffer from one or more of the following problems:

If the surfaces that the temporary movement joints seek to connect move relative to each other during settling, an air gap may be formed which leaves both the temporary movement joint and at least part of the tendon exposed to the atmosphere and thus subject to corrosion and the like until sealed.

There is significant difficulty in sealing the temporary movement joint—in particular the underside of the temporary movement joint.

A consequence of the first problem is that prior art temporary movement joints must be made from corrosion resistant materials, such as stainless steel. When combined with the fact that the materials must also be fire resistant or incorporate other attributes to meet building regulations, the cost of manufacturing such temporary movement joints may be up to ten times higher than the cost of manufacturing from less exotic materials.

The second problem presents a situation where the temporary movement joint is not adequately strengthened or that sealant may be lost from the joint. In both cases, a workman is then required to caulk the temporary movement joint at a later date and thus ensure that the temporary movement joint is properly sealed and thus locked in place. This requirement for remedial action is time-consuming and expensive in addition to delaying completion of the building. It is therefore an object of the present invention to provide a connector for use in forming joints that ameliorates, at least in part, one or more of the aforementioned problems.

SUMMARY OF THE INVENTION

Throughout this document, unless otherwise indicated to the contrary, the terms "comprising", "consisting of", and the like, are to be construed as non-exhaustive, or in other words, as meaning "including, but not limited to".

In accordance with a first aspect of the present invention there is a connector for use in forming a joint between a first surface and a second surface comprising: a hollow male member to be embedded in a first surface, the male member having an open ended protrusion extending therefrom;

a hollow female member to be embedded in the second surface, the female member having a mating opening for receiving the protrusion; and flexible sealing means for formed a fluid tight seal between the female member and male member, where, when installed, a tendon forming part of the first surface is able to extend through the protrusion into the female member and where, prior to grouting, movement of the tendon during settling of the first surface is facilitated by the male and female member without breaking the fluid tight seal formed by the flexible sealing means.

Preferably, the male member has a locator provided therein, the locator of slightly larger dimensions than those of the tendon, such that the tendon can be installed into the mated male and female member by way of the locator.

In this manner it is to be appreciated that there is no need for the connector to be made from corrosive resistant or fire resistant material as no part of it remains exposed after formation of the surfaces. Furthermore, no part of the tendon, also referred to hereafter as a dowel, is exposed when properly installed in such a connector.

In an alternative configuration of this aspect of the invention there is a connector for use in forming a joint between a first surface and a second surface comprising: a hollow male member to be embedded in a first surface, the male member having an open ended protrusion extending therefrom;

a hollow female member to be embedded in the second surface, the female member having a mating opening for receiving the protrusion; and flexible sealing means for formed a fluid tight seal between the female member and male member, where, when installed, a tendon forming part of the second surface is able to extend through the female member and thereafter into the protrusion and where, prior to grouting, movement of the tendon during settling of the second surface is facilitated by the male and female member without breaking the fluid tight seal formed by the flexible sealing means.

For this configuration, the female member may have a locator provided therein, the locator of slightly larger dimensions than those of the tendon, such that the tendon can be installed into the mated male and female member by way of the locator.

The flexible sealing means may form part of the hollow female member. Ideally, the flexible sealing means comprises a first seal and a second seal joined by a rubber extrusion and where the first seal is connected to the female member and the second seal is connected to the male member. The use of a flexible sealing means allows the dowel to move without breaking either seal.

The first seal may be received within a channel of the female member such that a mechanical seal is formed between the first seal and the channel. Preferably, the first seal has a circular cross section of greater dimension than the dimensions of the channel, such that the first seal deforms when received within the channel to create the mechanical seal. The channel may be formed when a fastening plate is attached to the chamber.

The open ended protrusion may have an inwardly tapering surface, the inwardly tapering surface operable to facilitate connection of the second seal to the open ended protrusion and, when subjected to telescopic movement during settling, operable to prevent disengagement of the second seal from the open ended protrusion.

The female member may have a first spigot and second spigot, each configured to receive a grout tube, such that grout pumped through the grout tube connected to the first spigot flows through the connector and exits the connector via the grout tube connected to the second spigot. Alternatively, the female member may have a first and second spigot, each configured to receive a grout tube, such that grout pumped through the grout tube connected to the first spigot flows through the connector and exits the connector via the grout tube connected to the second spigot. In yet a further alternative configuration, the male member may have a first and second spigot, each configured to receive a grout tube, such that grout pumped through the grout tube connected to the first spigot flows through the connector and exits the connector via the grout tube connected to the second spigot. The spigots, regardless of configuration, may have an enlarged head so that the grout tube is connected to the spigot by way of a forcible fit.

Utilising a configuration where the first and second spigot form part of the same member is advantageous as this allows for visual confirmation that grout tubes have been appropriately configured into the intended single continuous serpentine conduit.

The mating opening may take the form of a chamber of larger dimension than the remainder of the female member, the protrusion and sealing member being contained within the chamber.

The female member may have a fastening plate for facilitating attachment of the female member to formwork installed to facilitate formation of the second surface. Preferably, the fastening plate has at least one fastening hole for receiving a fastener and thereby facilitating attachment of the female member to the formwork. Furthermore, the fastening plate has at least one frangible section, the at least one fastening hole provided in at least one of the at least one frangible sections.

The use of a frangible section allows for retention of the female member to the formwork even when a disengaging force is applied to one of the fasteners (the frangible section incorporating that fastener merely operable to break away).

The male member may have a face plate, the face plate having a profile identical to the fastening plate, such that alignment of the face plate with the fastening plate corresponds with alignment of the male member with the female member. Additionally, a compressible material may be being arranged during installation to be positioned between the face plate and the fastening plate. The compressible material may incorporate adhesive means for creating a bond with either the face plate, the fastening plate or both the face plate and the fastening plate. The fastening plate may have has spacers positioned proximate the fastening holes.

The spacers act to compensate for the increase in overall dimensions caused by the inclusion of the compressible material.

The male and/or female member preferably has at least one lengthwise extending groove provided in its upper surface. When incorporated, best performance is achieved when the first and second spigot are positioned higher than the lengthwise extending groove relative to the upper surface of the male and/or female member, as appropriate.

The male member and/or the female member may have retaining means provided in its external surface for assisting in securely retaining the male and/or female member within its respective surface. Such retaining means may take one or more of the following forms: irregularities in the external surface; discontinuities in the external surface; ribs; corrugations; troughs; crests.

Preferably, the internal surface of the male and/or female member is smooth.

The male and/or female member may incorporate retaining means for releasably retaining a chair during installation.

In accordance with a second aspect of the invention there is a female member forming part of a connector for use in forming a joint between a first surface and a second surface as described in the first aspect of the invention.

In accordance with a third aspect of the invention there is a male member forming part of a connector for use in forming a joint between a first surface and a second surface as described in the first aspect of the invention.

In accordance with a fourth aspect of the invention there is a method of forming a joint between a first surface and a second surface comprising the steps of: affixing a female member of a connector as described in the first aspect of the invention to formwork for the second surface; creating the second surface with the female member embedded therein, such that an opening of the female member remains accessible on removal of the formwork; mating an open ended protrusion of a male member of the connector to the opening of the female member such that a flexible sealing means forms a fluid tight seal between the female member and the male member; installing a tendon to form part of the first surface through the protrusion into the female member; creating the first surface with the male member embedded therein; and grouting the connector where, movement of the tendon during settling of the first surface is facilitated by the male and female member without breaking the fluid tight seal formed by the flexible sealing means.

In an alternative configuration of this aspect of the invention, there is a method of forming a joint between a first surface and a second surface comprising the steps of:

affixing a female member of a connector as described in the first aspect of the invention to formwork for the second surface; creating the second surface with the female member embedded therein, such that an opening of the female member remains accessible on removal of the formwork; mating an open ended protrusion of a male member of the connector to the opening of the female member such that a flexible sealing means forms a fluid tight seal between the female member and the male member; installing a tendon to form part of the first surface through the protrusion into the male member; creating the first surface with the male member embedded therein; and grouting the connector where, movement of the tendon during settling of the first surface is facilitated by the male and female member without breaking the fluid tight seal formed by the flexible sealing means.

The method may further include the step of forming a mechanical seal between the first seal and a channel of the female member. Associated with this step, the method may also include the step of creating the channel by attaching a fastening plate to a chamber forming part of the female member.

The method may further include the step of inserting the open ended protrusion through the second seal, such that an inwardly tapering surface of the open ended protrusion facilitates this insertion while, when the male and female members are subjected to telescopic movement during settling, operable to prevent disengagement of the second seal from the open ended protrusion.

The method may further include the step of connecting a grout tube to each of a pair of spigots attached to the male member and/or the female member, such that grout pumped through a first spigot flows through the connector and exits the connector via the grout tube connected to a second spigot. Preferably, the method also includes the step of connecting a free end of the grout tube connected to the second spigot of a first connector to the first spigot of a second connector.

In this manner, the desired continuous serpentine conduit can be formed between connectors.

The method may further include the step of aligning a fastening plate of the female member to a face plate of the male member. Associated with this step, the method may also comprise the step of installing a compressible material between the face plate and the fastening plate. Ideally, this compressible material creates a bond with the face plate, the fastening plate or both the face plate and the fastening plate.

The method may further include the step of releasably retaining a chair to maintain the level of the male member and/or female member during installation. The method may further include the step of removing a protective cover from the opening of the female cover after creation of the second surface. The use of the protective cover assists in preventing contaminants that may otherwise break the seal from entering the female member during creation of either the first or second surface.

In accordance with a fifth aspect of the invention there is a connection set for forming a joint between a vertical surface and a horizontal surface, the connection set comprising: an anchor head having a threaded portion for embedding in the vertical surface;

a dowel having a mating threaded portion;

a hollow male member to be received in the vertical surface, the male member having an open ended protrusion extending therefrom and an open ended body;

a hollow female member to be embedded in the horizontal surface, the female member having a mating opening for receiving the protrusion; and flexible sealing means for formed a fluid tight seal between the female member and male member, where, when installed, the tendon is matedly connected to the anchor head by way of the threaded portions and unmated end of the tendon extends through the protrusion into the female member such that, prior to grouting, movement of the tendon during settling of the horizontal surface is facilitated by the male and female member without breaking the fluid tight seal formed by the flexible sealing means.

The set may include a wall plate, the wall plate having a cylinder having a threaded portion, the cylinder operable to matedly connect to the anchor head by way of the threaded portions, and thereby retain the anchor head in place during creation of the vertical surface.

The open ended body may include a positioning rim, the positioning rim having a diameter smaller than the diameter of the cylinder. By utilising a positioning rim having a diameter smaller than the diameter of the cylinder, when the wall plate is removed and the male member installed in its place, a seal tight fit is formed by the male member to the vertical surface.

In accordance with a sixth aspect of the invention there is a method of forming a joint between a vertical surface and a horizontal surface comprising the steps of: fastening a wall plate to formwork for the creation of the vertical surface;

connecting an anchor head to a cylinder portion of the wall plate;

forming the vertical surface with the anchor head and wall plate formed therein;

removing the wall plate from the vertical surface;

connecting a dowell to the anchor head embedded in the vertical surface;

installing a male member into the area formed by the removal of the wall plate from the vertical surface, the male member having an open ended protrusion through which the dowel extends;

mating the open ended protrusion of the male member to an opening of a female member, such that a flexible sealing means forms a fluid tight seal between the female member and the male member; creating the horizontal surface with the female member embedded therein; and grouting the connector.

The method may further include the step of forming a mechanical seal between the first seal and a channel of the female member. As a related step, the method may also include the step of creating the channel by attaching a fastening plate to a chamber forming part of the female member.

The method may further include the step of inserting the open ended protrusion through the second seal, such that an inwardly tapering surface of the open ended protrusion facilitates this insertion while, when the male and female members are subjected to telescopic movement during settling, operable to prevent disengagement of the second seal from the open ended protrusion.

The method may further include the step of connecting a grout tube to each of a pair of spigots attached to the female member, such that grout pumped through a first spigot flows through the connector and exits the connector via the grout tube connected to a second spigot. As a related issue, the method may further include the step of connecting a free end of the grout tube connected to the second spigot of a first female member to the first spigot of a second female member.

The method may further include the step of aligning a fastening plate of the female member to a face plate of the male member.

The method may further include the step of installing a compressible material between the face plate and the fastening plate. This compressible material may be used to create a bond with the face plate, the fastening plate or both the face plate and the fastening plate.

The method may further include the step of releasably retaining a chair to maintain the level of the female member during installation.

BRIEF DESCRIPTION OF THE DRAWINGS

The invention will now be described, by way of example only, with reference to the accompanying drawings, in which:

FIGS. 9-1 to 9-8 are individual schematic perspective views of the various stages of using the connector as shown in FIG. 1 to connect two slabs of a floor;

PREFERRED EMBODIMENTS OF THE INVENTION

Figure 1:
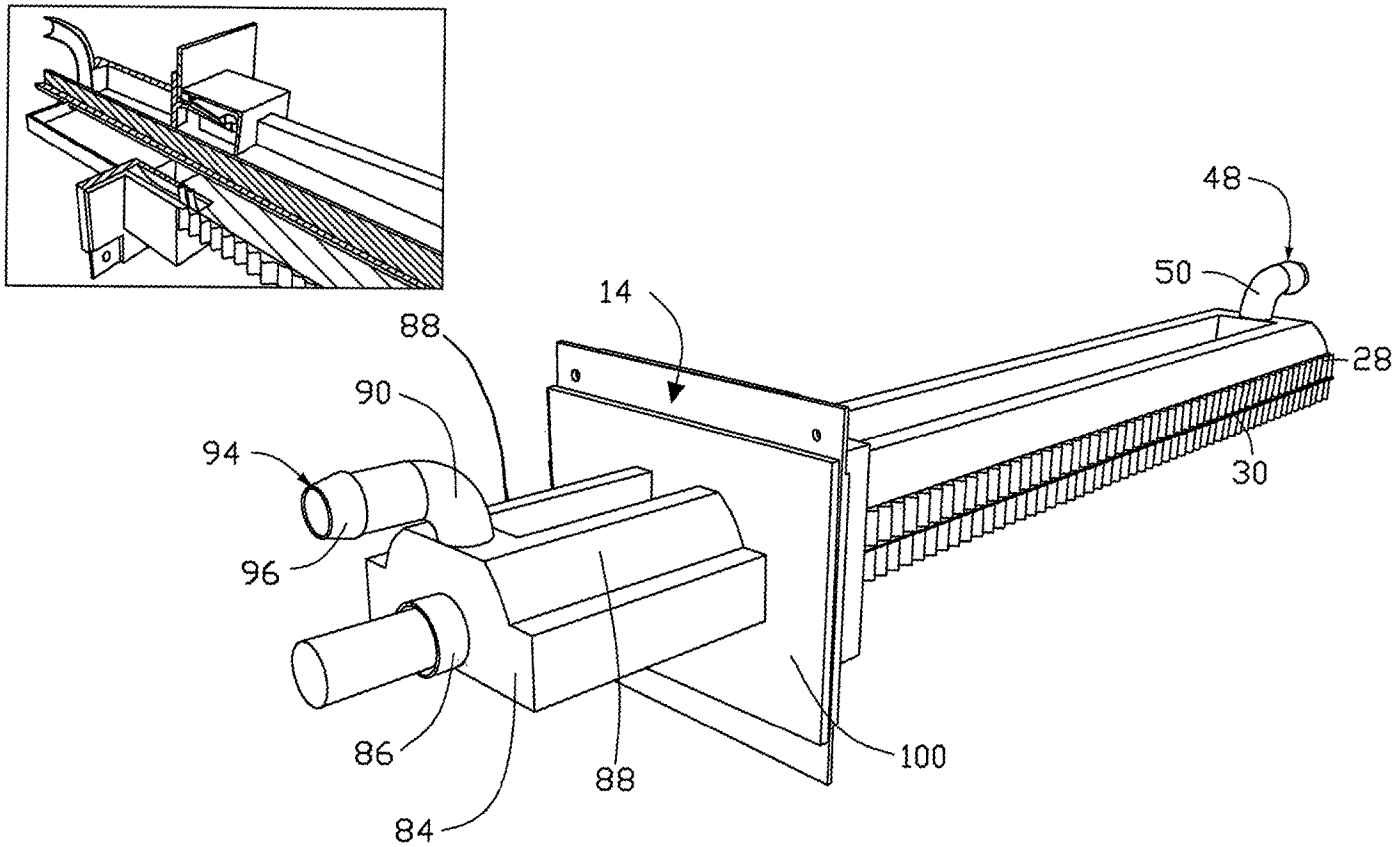
FIG. 1 is a perspective view of one form of a connector according to a first embodiment of the invention in an assembled form and shown in isolation.

In accordance with a first embodiment of the invention there is a connector 10 for use in forming joints. The connector 10 comprises:

a sleeve 12;

a fastening plate 14;

a sealing member 16; and a cap 18.

In essence, the invention sees the sleeve 12 used for secure attachment to a first section or slab of flooring 20. The cap 18 is used for secure attachment to a second section or slab of flooring 22. In combination, the sleeve 12 and cap 14 cooperatively engage with one another to form a fluid-tight connection at the interface 24 of the two sections or slabs 20, 22.

Sleeve 12 has a front end 26, a rear end 28 and sides 30. The majority of the sleeve 12 takes the form of an elongate portion forming a housing 32 for receiving and protecting a first part of a reinforcement dowel 34 forming part of the first section or slab of flooring 20. The length (L) of the housing 32 corresponds with the length of the first part of the reinforcement dowel 34.

The internal lower surface (not shown) of the housing 32 is substantially smooth so as to assist in the flow of grout (not shown) through the sleeve 12. Utilising a substantially smooth internal lower surface also reduces the formation of air bubbles, air locks, air pockets or the like that may weaken the fastening of the sleeve 12 to the reinforcement dowel 34 when sealed with grout.

At least one of sides 30 are provided with surface irregularities or discontinuities in the form of ribs 38. The ribs 38 assist in securely retaining the submerged sleeve 12 in the first section or slab of flooring 20 when in its uncured state.

Positioned at the front end 26 of the sleeve 12 is a chamber 40. Chamber 40 takes the form of a generally rectilinear three dimensional rectangular prism with open faces 42*a*, 42*b*. The role of open face 42*a* will be described in more detail below.

Open face 42*b* allows for fluid communication between the chamber 40 and the housing 32.

Extending along an upper surface 44 of the sleeve 12 are a pair of lengthwise extending grooves 46. Each groove 46 acts as a flow path for the grout when introduced into the sleeve 12. The grooves 46 also operate to reduce the formation of air bubbles, etc.

A first port 48 is provided in the upper surface 44 at the rear end 28 of the sleeve 12. In this embodiment, the first port 48 takes the form of a hollow right angle elbow 50 having an enlarged head 52. The hollow nature of the first port 48 allows for fluid communication between the first port 48 and the interior of the sleeve 12.

The enlarged head 52 has a tapering rim or edge 54 for receiving and retaining a hose (not shown).

It is important to note that the enlarged head 52 must be at a level higher than the level of the extending grooves 46 to ensure that the entire connector 10 is appropriately grouted when required.

Figure 5:
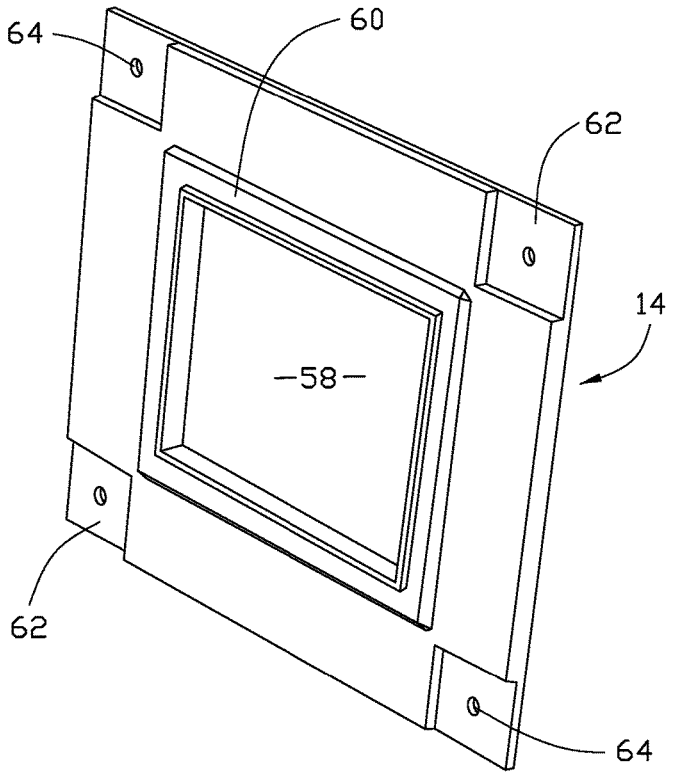
FIG. 5 is a perspective view of a fastening plate that forms part of the connector as shown in FIG. 1.

The fastening plate 14 is generally planar and rectangular in shape. The fastening plate 14 is welded to open face 42*a* of the chamber 30. The dimensions of the fastening plate 14 are greater than that of open face 42*a* as shown in FIG. 5.

Positioned centrally within the fastening plate 14 is an aperture 58. The aperture 58 is of size and shape slightly smaller than that of open face 42*a*. Surrounding the periphery of the aperture 58 is a flange 60. The role of the flange 60 will be described in more detail below.

Figure 4:
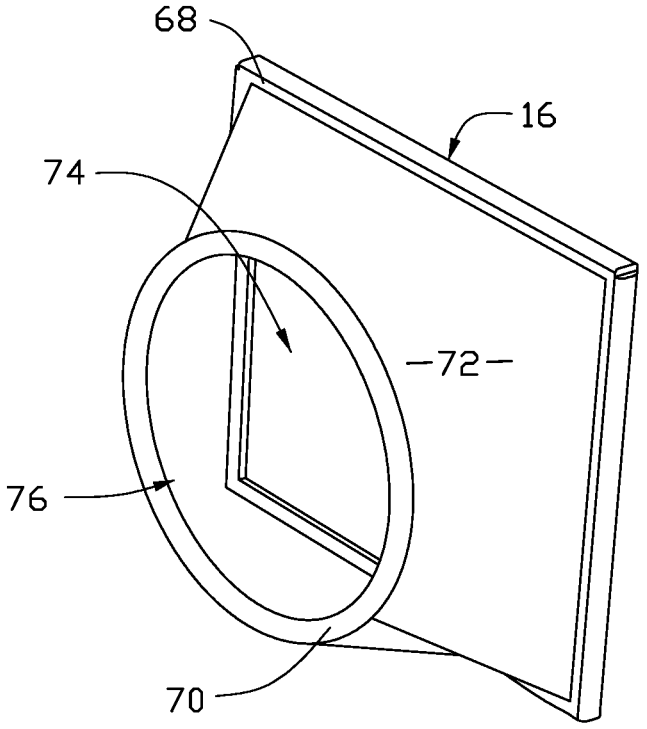
FIG. 4 is a perspective view of a sealing means that forms part of the connector as shown in FIG. 1.

Each corner of the fastening plate 14 has a frangible section 62 that can be broken off as and when required. A fastening hole 64 is provided in each frangible section 62. In this manner, the frangible section 62 can break away from the fastening plate 14 should a fastener (not shown) holding the sleeve 12 to the formwork tries to pull the fastening plate 14 off the sleeve 12. The sealing member 16 comprises a first seal 68 and a second seal 70. A hollow rubber extrusion 72 extends between the first seal 68 and the second seal 70 as shown in FIG. 4. The first and second seal 68, 70 are both circular in cross-section.

A first opening 74 is located where the rubber extrusion 72 meets the first seal 68. A second opening 76 is located where the rubber extrusion 72 meets the second seal 70.

The first seal 68 surrounds the periphery of the first opening 74. In this embodiment, the first seal 68 is rectangular in shape so as to match the internal profile of the chamber 40, i.e. open face 42*a*.

The second seal 70 surrounds the periphery of the second opening 76. In this embodiment the second seal 70 is circular in shape so as to match the internal profile of the sleeve 12.

Figure 6:
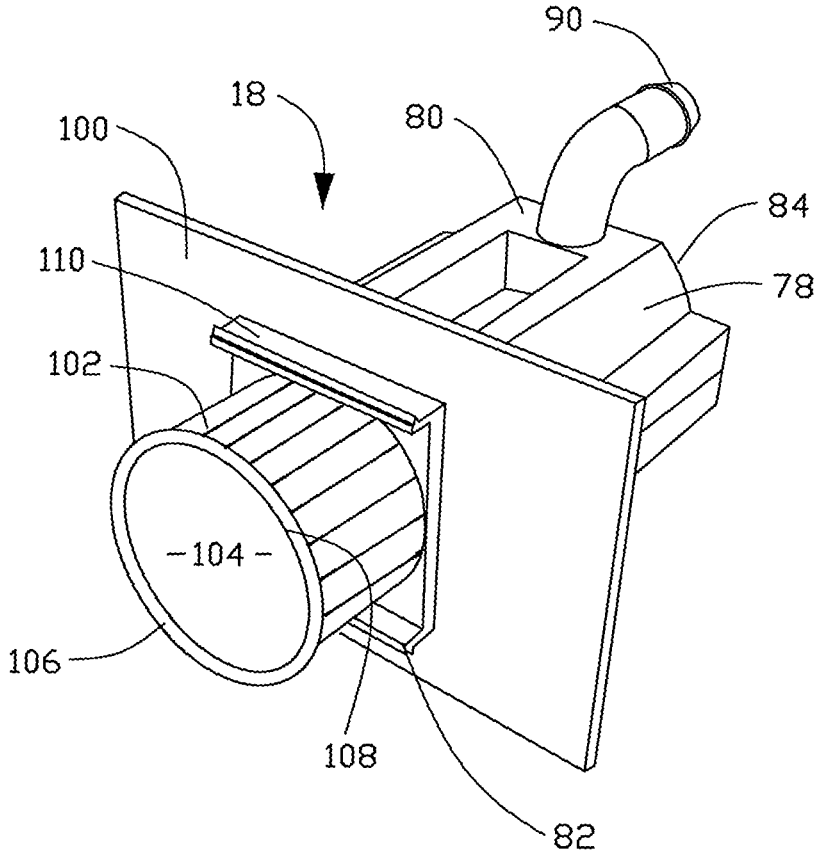
FIG. 6 is a perspective view of a cap that forms part of the connector as shown in FIG. 1.

The cap 18 comprises a hollow body 78 having an upper or top surface 80, a front end 82 and a rear end 84 as shown in FIG. 6. Extending from the rear end 84 is a locator 86. In this embodiment, the locator 86 takes the form of a circular collar. The locator 86 operates to receive and protect the first part of the reinforcement dowel 34 forming part of the second section of the slab or flooring 22. As such the locator 86 should be of slightly larger dimensions than the reinforcement dowel 34.

Extending along the upper surface 80 of the cap 18 are a pair of lengthwise extending grooves 88. Each groove 88 acts as a flow path for grout when introduced into the cap 18. The grooves 88 also operate to reduce the formation of air bubbles, etc.

An upwardly directed second port 90 extends from the upper surface 80 at a position at or towards rear end 84. In this embodiment, the second port 90 again takes the form of a hollow right angle elbow 92 having an enlarged head 94. The hollow nature of the second port 90 allows for fluid communication between the second port 90 and the hollow body (not shown) of cap 18.

The enlarged head 94 has a tapering rim or edge 96 for receiving and retaining a grout tube or pipe. Once again, it is important to note that the enlarged head 94 must be at a level higher than the level of the extending grooves 88 to ensure that the entire connector 10 is appropriately grouted when required.

A face plate 100 is located towards the front end 82. The face plate 100 is of general size and shape commensurate with fastening plate 14.

Extending forwardly from the face plate 100 is a hollow cylindrical male member 102. In this embodiment, the cylindrical male member 102 takes the form of an extension tube. Surrounding open end 104 of the cylindrical male member 102 is a rim 106. The rim 106 has an inwardly tapering surface 108.

The hollow nature of the cylindrical male member 102 means that the interior of the cylindrical male member 102 is in fluid communication with the hollow body 78.

Figure 8:
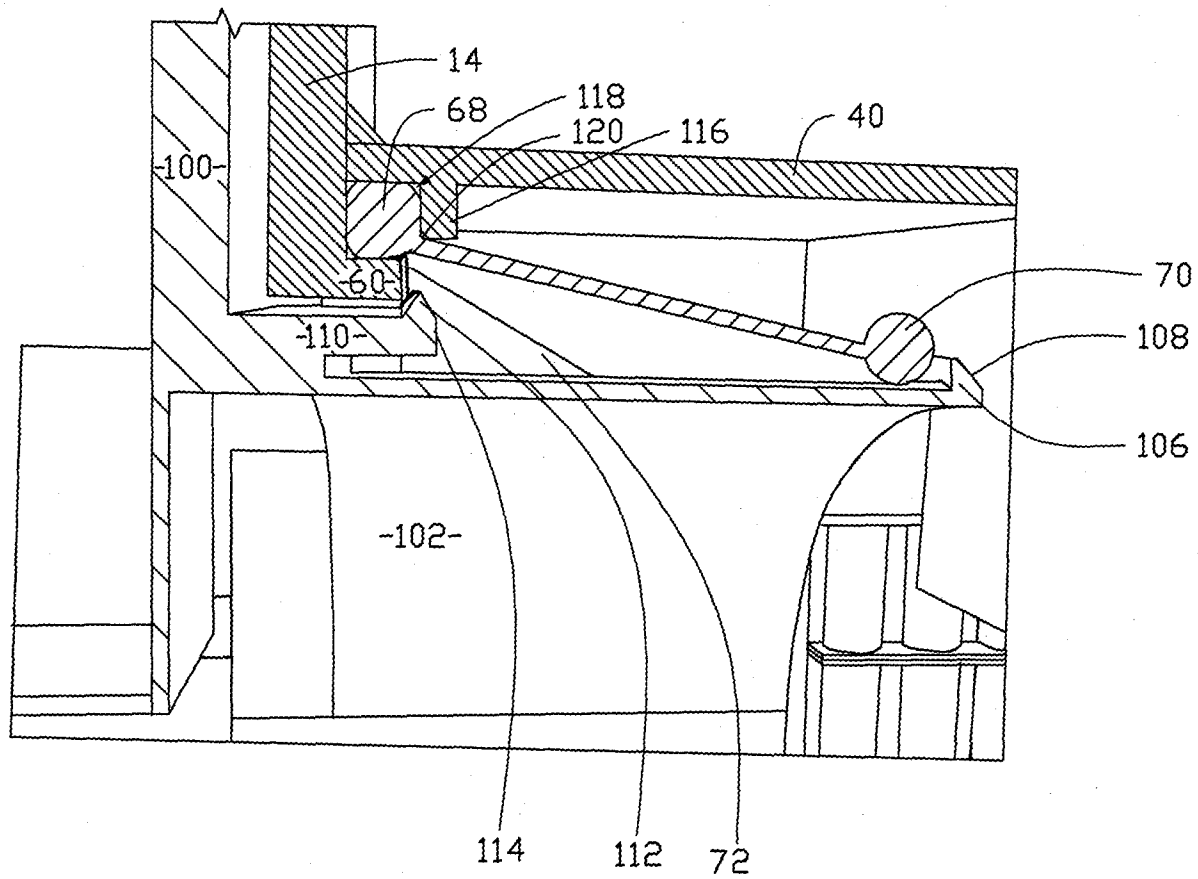
FIG. 8 is a second partial cross-sectional view of the connector as shown in FIG. 1.

Positioned above the cylindrical male member 102 is a retaining clip 110. The retaining clip 110 projects from the face plate 100 in a direction substantially parallel to the cylindrical male member 102. A lip 112 extends from free end 114 of the retaining clip 110. Lip 112 projects away from the cylindrical male member 102. In this embodiment, lip 112 has a triangular cross-section as shown in FIG. 8.

The retaining clip 110 has a width (W-i) less than the width of the cylindrical male member 102 (W2).

As the connector 10 is ultimately supplied as a combination of male (cap 18) and female (sleeve 12, fastening plate 14 and sealing member 16) members it is important to describe the means by which the female member is assembled.

Figure 7:
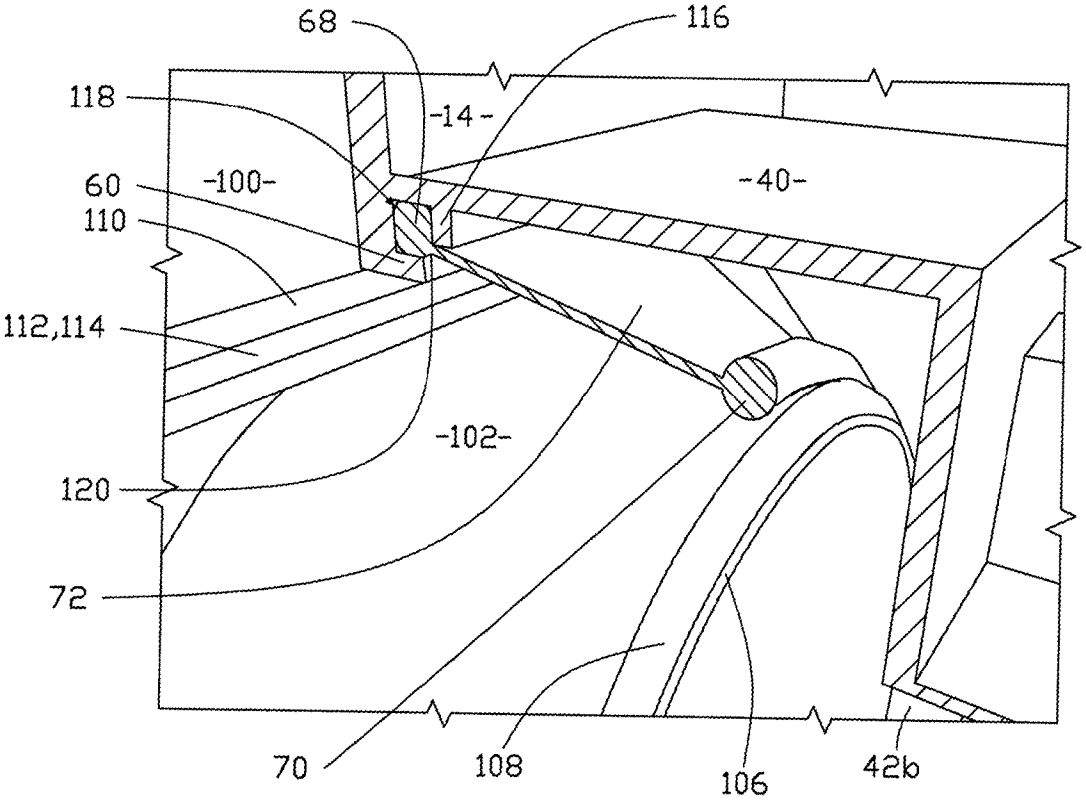
FIG. 7 is a first partial cross-sectional view, taken in perspective, of the connector as shown in FIG. 1.

To assemble the female member, the sealing member 16 is inserted into open face 42*b* of chamber 40. Insertion of the sealing member 16 continues until first seal 68 makes contact with abutment 116. This arrangement sees second opening 76 positioned central relative to open face 42*a*, but spaced therefrom. These requirements are illustrated in FIGS. 7 and 8.

With the sealing member 16 properly inserted, the fastening plate 14 is then installed. Installation of the fastening plate 14 sees flange 60 received within open face 42*a*. More importantly, the installation of the fastening plate 14 defines a square channel 118. To elaborate, the square channel 118 is defined by fastening plate 14, flange 60, chamber 30 and abutment 116. It is to be noted that the flange 60 and abutment 116 do not meet, such that the square channel 118 has an opening 120.

The creation of the square channel 118 also operates to retain the first seal 68. It should be noted here that the dimensions (S) of the square channel 118 are smaller than the diameter (D) of the first seal 68. Hence, retention of the first seal 68 within the square chamber 118 causes it to deform and mechanically seal the square chamber 118. The rubber extrusion 72 extends out from the square channel 118 through opening 120.

To ensure that the square chamber 118 remains mechanically sealed while subjected to the varying forces that occur during settling of the flooring sections 20, 22, the fastening plate 14 is friction welded to the sleeve 12.

This embodiment will now be described in the context of its intended use. Note that for the remainder of the specification:

- the respective parts of the reinforcing dowels 34 will be referred to by the term "dowel" which is in more common usage as its descriptor in industry; and
- the term sleeve 12 will be used as a reference to a sleeve 12 as assembled with the fastening plate 14 and sealing member 16 (i.e. the female member as described above).

When it is required to join two concrete slabs 20, 22 across a common join, formwork 122 is prepared in accordance with the location and size and shape of the floor to be formed. This formwork 122 includes mostly horizontal boards 124 for forming the floor. Substantially vertical formwork strips 126 are securely connected to the horizontal boards 124 where a joining edge of the floor is to be formed.

Figures 1, 9:
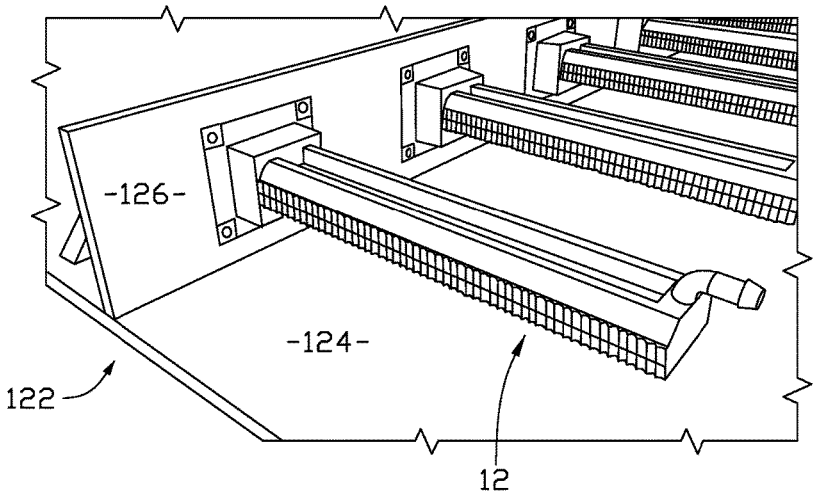
Figures 2, 9:
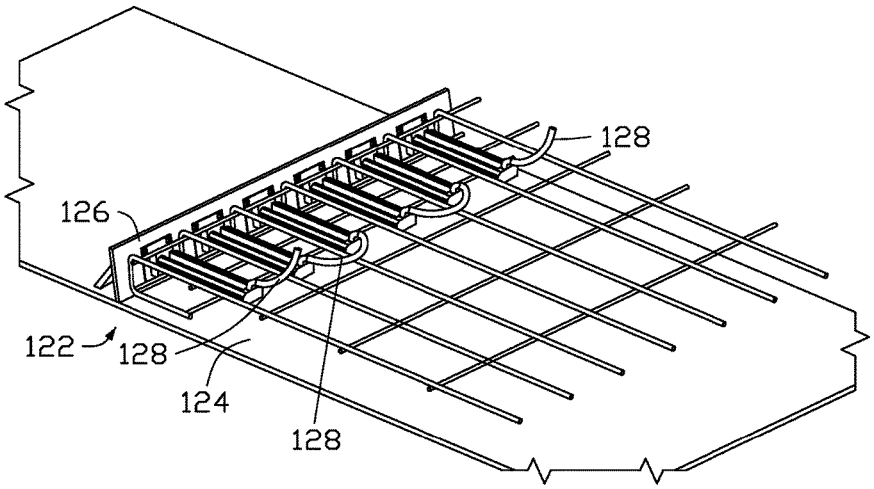
Figures 3, 9:
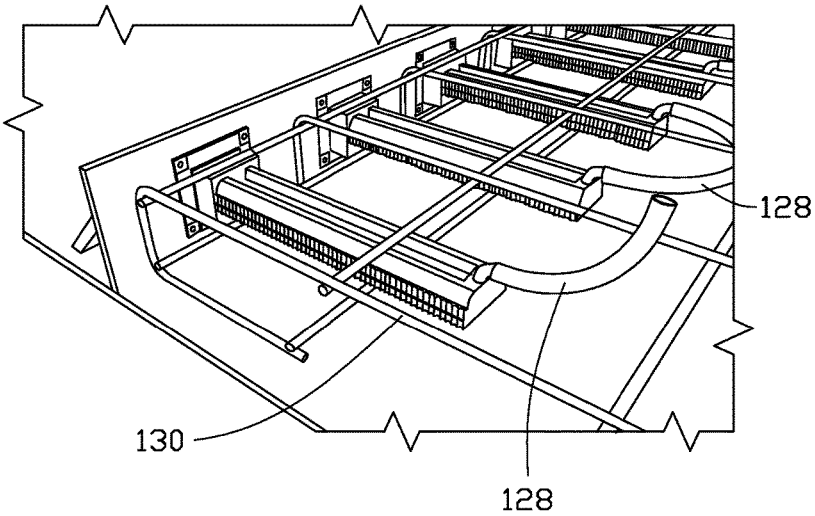
Figures 4, 9:
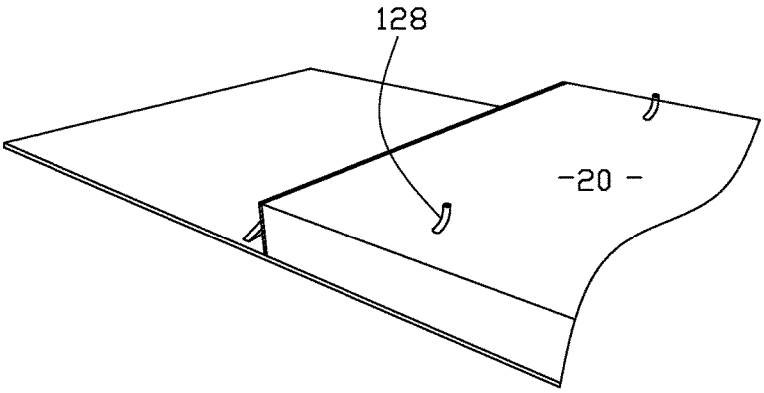
Figures 5, 9:
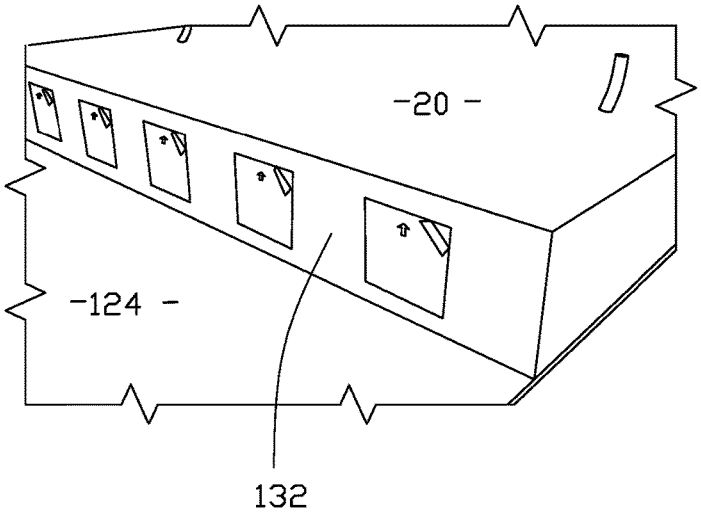
Figures 6, 9:
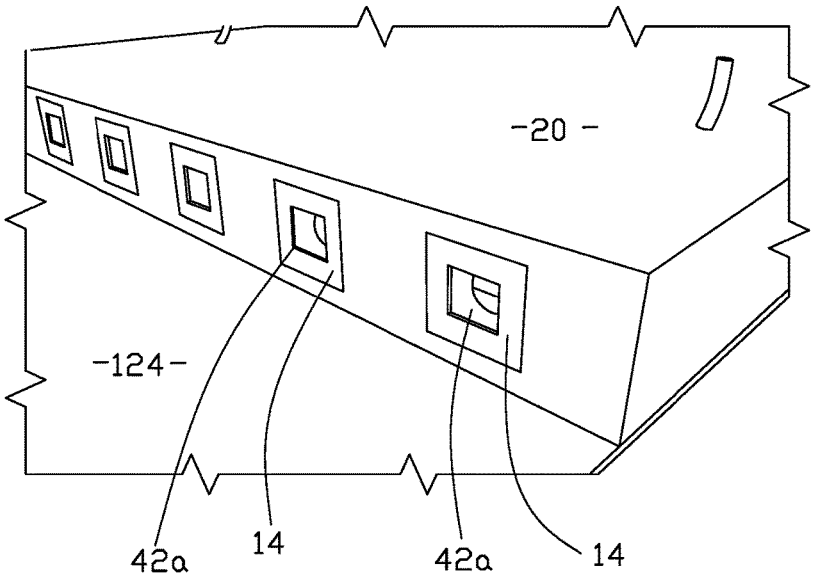
Figures 7, 9:
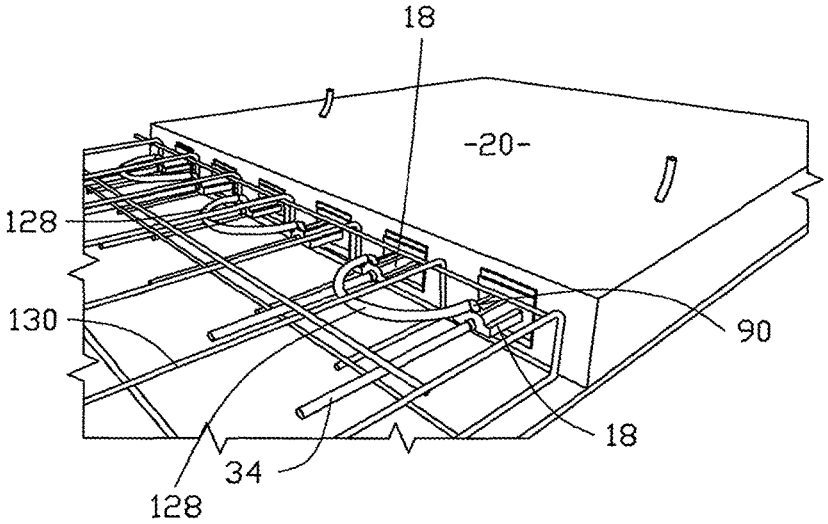
Figures 8, 9:
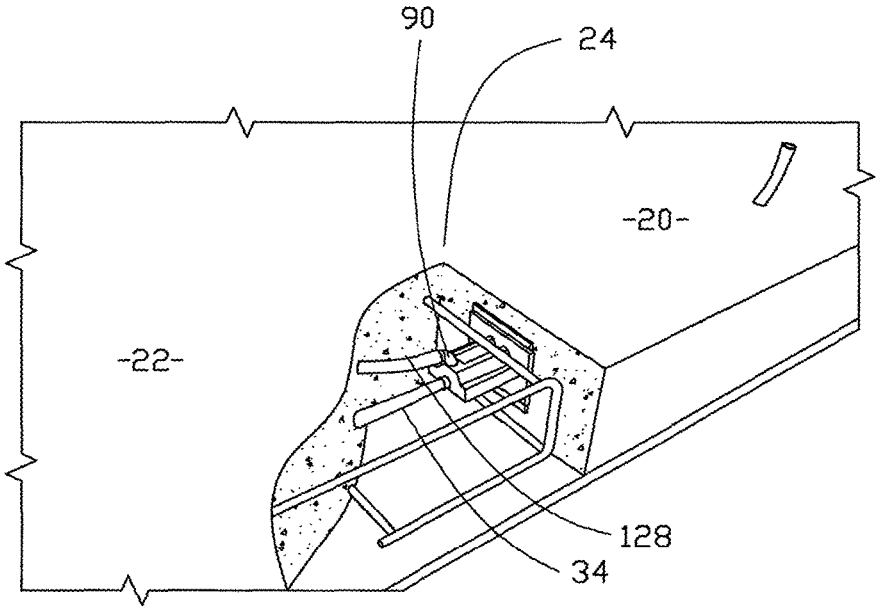
Figure 10:
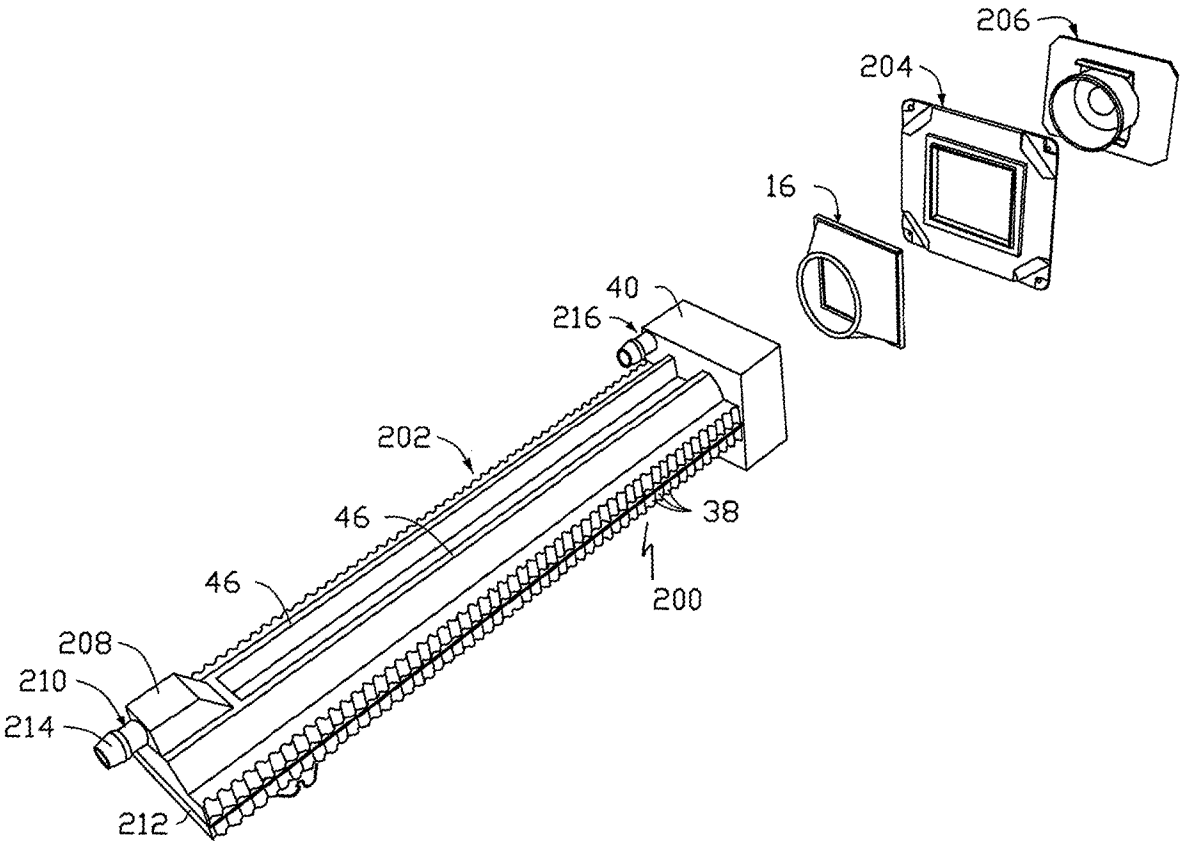
FIG. 10 is an exploded perspective view of a connector according to a second embodiment of the invention.
Figure 11:
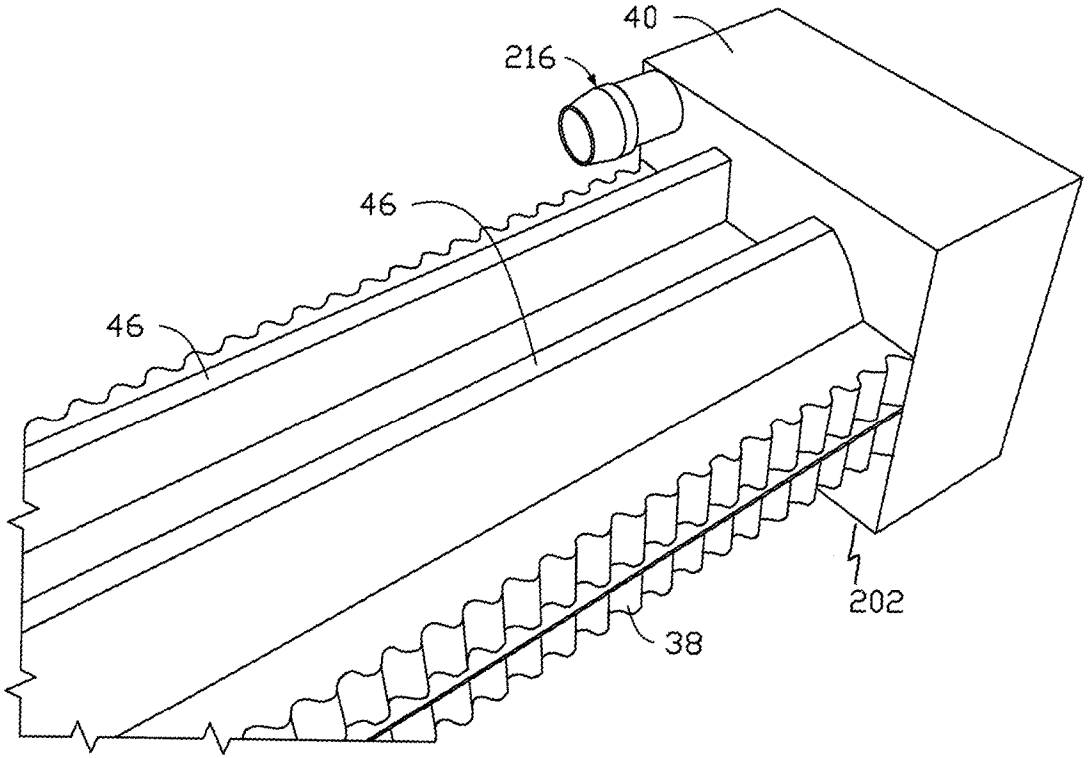
FIG. 11 is a partial perspective view of a sleeve that forms part of the connector as shown in FIG. 10.
Figure 12:
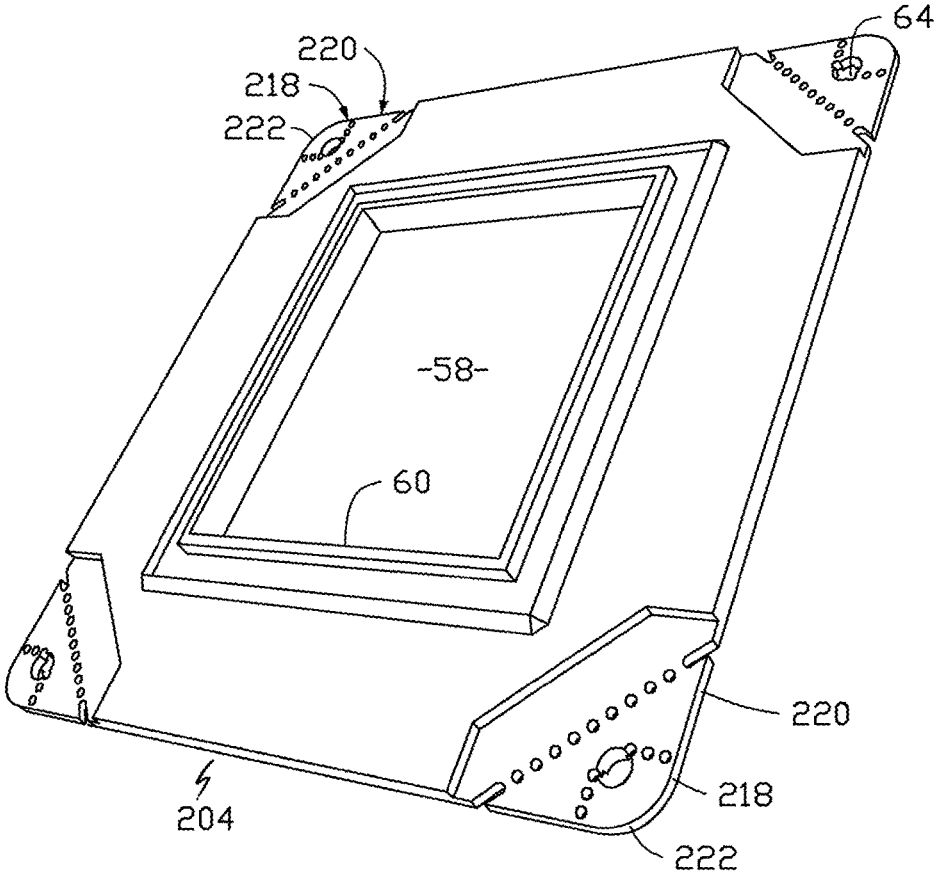
FIG. 12 is a perspective view of a fastening plate that forms part of the connector as shown in FIG. 10.

Nailed into at least one vertical formwork strip 126 is a sleeve 12. Ideally, as is shown in FIGS. 9-1 through 9-8, the sleeves 12 are nailed to vertical formwork strips 126 at regularly spaced apart locations along the length of the formwork 122. A grout tube 128 is then forcibly fitted to the enlarged head 52 of a first port 48 of a sleeve 12 nailed to a peripheral of the vertical formwork strip 126. Grout tubes 128 are then securely forcibly fitted to the enlarged head 52 of the first port of every second sleeve 12 nailed to the vertical formwork strip 126. If the number of sleeves 12 nailed to the vertical formwork strip 126 is not an even number, a final grout tube 128 is securely connected to the enlarged head 52 of the first port 48 of the final sleeve 12 nailed to the vertical formwork strip 126.

Figure 2:
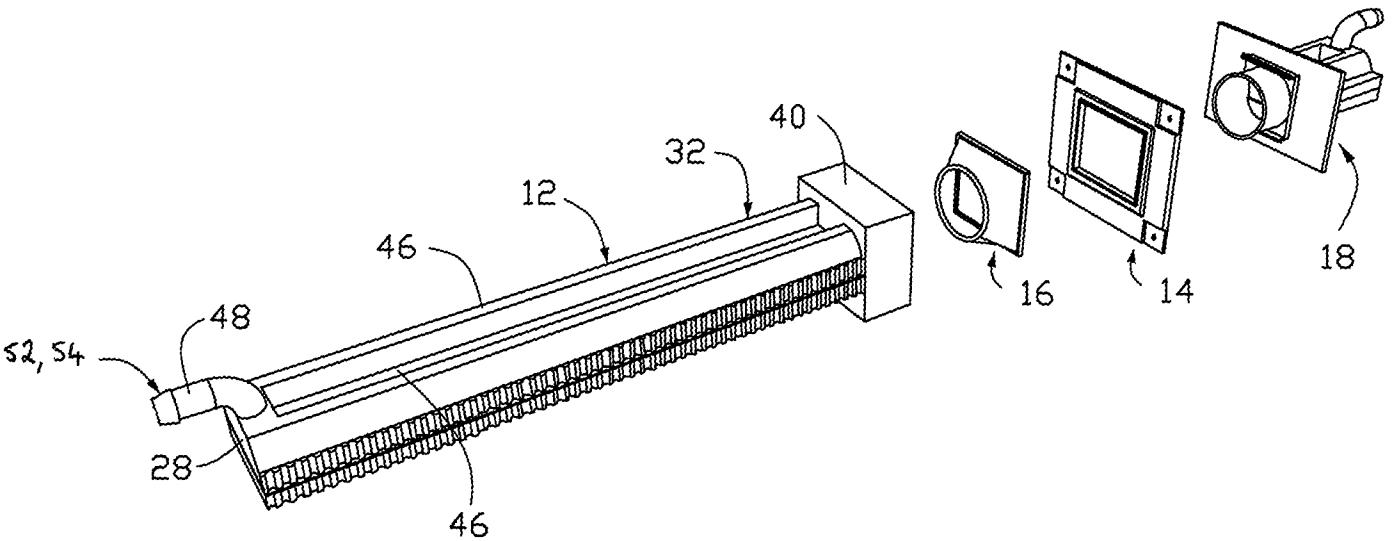
FIG. 2 is an exploded perspective view of the connector as shown in FIG. 1.
Figure 3:
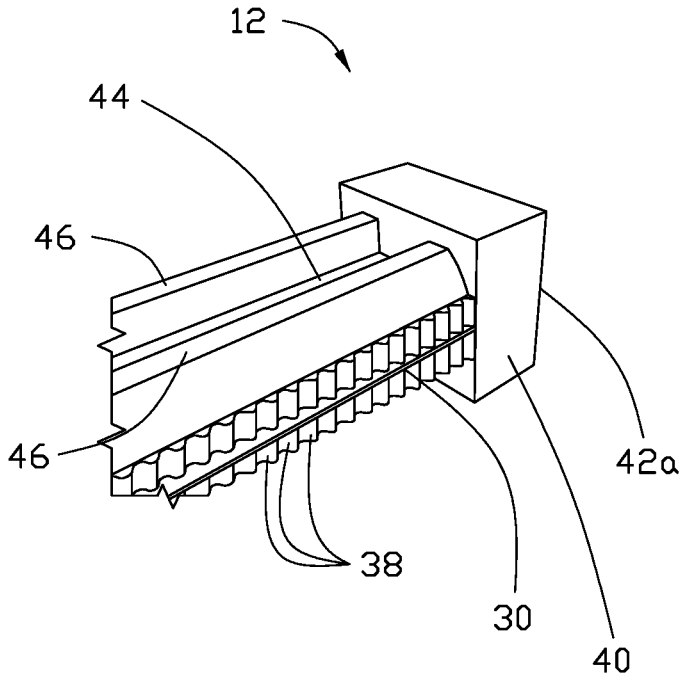
FIG. 3 is a partial perspective view of a sleeve that forms part of the connector as shown in FIG. 1.

The grout tube 128 securely connected to the peripheral of the vertical formwork strip 126 and the final grout tube 128, if any, remain free and are manipulated to extend primarily upwards to a position above the intended working surface of the first section of flooring 20. However, the unconnected end of each intervening grout tube 128 is manipulated so as to securely connect to the enlarged head 52 of the first port 48 of the next sleeve 12 nailed to the vertical formwork strip 126. This arrangement is shown visually in FIG. 9-2.

Concrete reinforcing in the form of mesh 130 is then placed over the horizontal boards 124 and positioned such as to be embedded in the first section of flooring 20 when poured. With all of the mesh 130 appropriately positioned, the uncured concrete is poured to create the first section of flooring 20. Once the first section 20 has cured, the vertical formwork strip 126 is removed and the joining surface 132 of the poured section 20 is cleaned so as to be free of debris. Open faces 42*a* of each sleeve 12 are similarly cleaned.

Once cleaned, caps 18 are attached to each sleeve 12.

Attaching the cap 18 to the sleeve 12 is achieved by initially inserting the cylindrical male member 102 into open face 42*a*. At some point during the insertion process, the rim 106 will make contact with the rubber extrusion 72. At this time, further insertion of the cap 18 will encounter resistance, but due to the inwardly tapering surface 108 of the rim 106, the rubber extrusion 72 and second seal 70 will be forced to stretch until the rim 106 passes through the second seal 70.

When the rim 106 passes through the second seal 70, the rubber extrusion 72 and second seal 70 seek to contract to their original form. The presence of the cylindrical male member 102 prevents this from happening but acts as a clamping force for the second seal 70. The second seal 70, under influence of this clamping force, thus seals the connection between sealing member 16 and cylindrical male member 102.

With the rim 106 having passed through the second seal 70, retaining clip 110 is now proximate square channel 118. The proximity to the square channel 118 is such that lip 112 is able to protrude into opening 120 as shown clearly in FIG. 8. When so positioned, an audible sound is made as an indicator to the installer that the cap 18 is now attached to the sleeve 12. However, it should be noted that this connection is not permanent or secure and that the lip 112 can easily be removed from the opening 120 with the application of low level force.

The cap 18 now properly installed in the sleeve 12, a dowel 34 is inserted into the connector 10. Insertion of the dowel 34 is by way of locator 18. The dowel 34 is preferably pushed into the connector 10 until such time as the dowel 34 abuts internal wall (not shown) of rear end 28.

Starting from the cap 18 connected to the sleeve 12 that was nailed to the peripheral of the vertical formwork strip 126, grout tubes 128 are securely connected to the enlarged head 94 of the second port 90 of every second cap 18.

The unconnected end of each grout tube 128 is then connected to the enlarged head 94 of the second port 90 of the next cap 18. If there is not an even number of caps 18 connected to sleeves 12, the grout tube 128 connected to the final cap 18 is manipulated to extend primarily upwards to a position above the intended working surface of the second section of flooring 22.

In this manner, the grout tubes 128 connect the connectors 10 in a manner that creates a single, serpentine conduit for grout to flow through.

Concrete reinforcing in the form of mesh 130 is then placed over the horizontal boards 124 and positioned such as to be embedded in the second section of flooring 22 when poured along with the portion of dowel 34 not received within the connector 10. With all of the mesh 130 appropriately positioned, the uncured concrete is poured to create the second section of flooring 22.

As the second section of flooring 22 settles, the connector 10 allows the two flooring sections 20, 22 to move relative to each other in the two horizontal planes, but restrict all movement of the two flooring sections 20, 22 relative to each other in the vertical plane.

To elaborate, the movement likely to occur during settling of the second section of flooring 22 is likely to be powerful, but very minor (an extreme allowance of 10 mm is provided perpendicular to the line of dowel 34 and 20 mm parallel to the line of dowel 34). As the retaining clip 110 has a width (W-i) less than the width of the cylindrical male member 102 (W2), side to side movement of cap 18 relative to the sleeve 12 is facilitated by movement of the lip 112 relative to the flange 60. Telescopic movement of the cap 18 relative to the sleeve 12 is facilitated by disconnection of the lip 112 from the flange 60 as already been described.

In both cases, the integrity of the first seal 68 and second seal 70 is maintained throughout the movement as the rubber extrusion 72 deforms to meet the movement. For telescopic movement, the compressive force of the second seal 70, in addition to the inwardly tapered profile 108 or rim 106, ensures that the second seal 70 moves with the cylindrical male member 102 and thereby retains the seal.

Once the designated cure time has passed, or an appropriately qualified professional believes that the second section of flooring 22 has settled, one or both of the exposed grout tubes 128 are appropriately connected to a pump. Grout is then pumped through the exposed grout tubes 128. Due to the interconnection of the grout tubes 128 and connectors 10 as already described, as the grout enters into each connector 10 it fills up the empty spaces and thereby fills the sealed the connector 10 (i.e. the connector 10 is grouted). As the first and second seals 68, 70 remain intact, grout does not enter into the area defined by rubber extrusion 72, face plate 100 and cylindrical male member 102. If grout where to enter this area, second seal 70 may be broken.

Once all connectors 10 have been grouted, and the grout has changed from its liquid state to a solid state, the exposed grout tubes 128 are then terminated according to the architectural requirements of the finished slab (i.e. the joined first and second sections of flooring 20, 22). When the grout has cured to the required strength inside of connector 10, the first and second surfaces 20, 22 are then locked together to form a permanent state continuous slab with full structural integrity. In accordance with a second embodiment of the invention, where like numerals reference like parts, there is a connector 200 for use in forming joints. The connector 200 comprises a sleeve 202, a fastening plate 204, sealing member 16 and cap 206. Sleeve 202 and fastening plate 204 are minor variations of sleeve 12 and fastening plate 14 and the sealing member 16 is identical to that described in the first embodiment.

For sleeve 202, first port 48 is replaced with a mounting platform 208 and first spigot 210. The mounting platform 208 replaces the extending grooves 46 at the rear end 28. The mounting platform 208 raises to a height above the upper surface 44 significantly above extending grooves 46.

First spigot 210 extends from rear side 212 of the mounting platform 208. The first spigot 210 has an enlarged head 214.

Extending from rear side 214 of the chamber 40 is a second spigot 216. The second spigot 216 is of identical construction to first spigot 210.

In all other respects, sleeve 202 is of identical construction to that of sleeve 12.

Fastening plate 204 has first frangible sections 218 and a second frangible sections 220. The first frangible sections 218 occupy each corner 222 of the fastening plate 204. The first frangible section 218 incorporates part of the periphery of the fastening hole 64. The second frangible section 220 includes the first frangible section 218.

Figure 13:
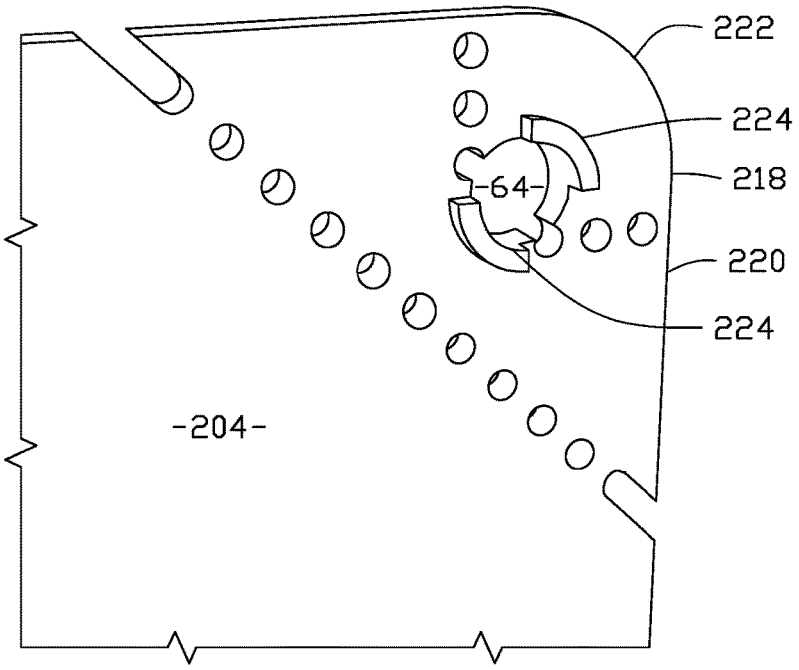
FIG. 13 is a rear view of the fastening plate shown in FIG. 12.
Figure 14:
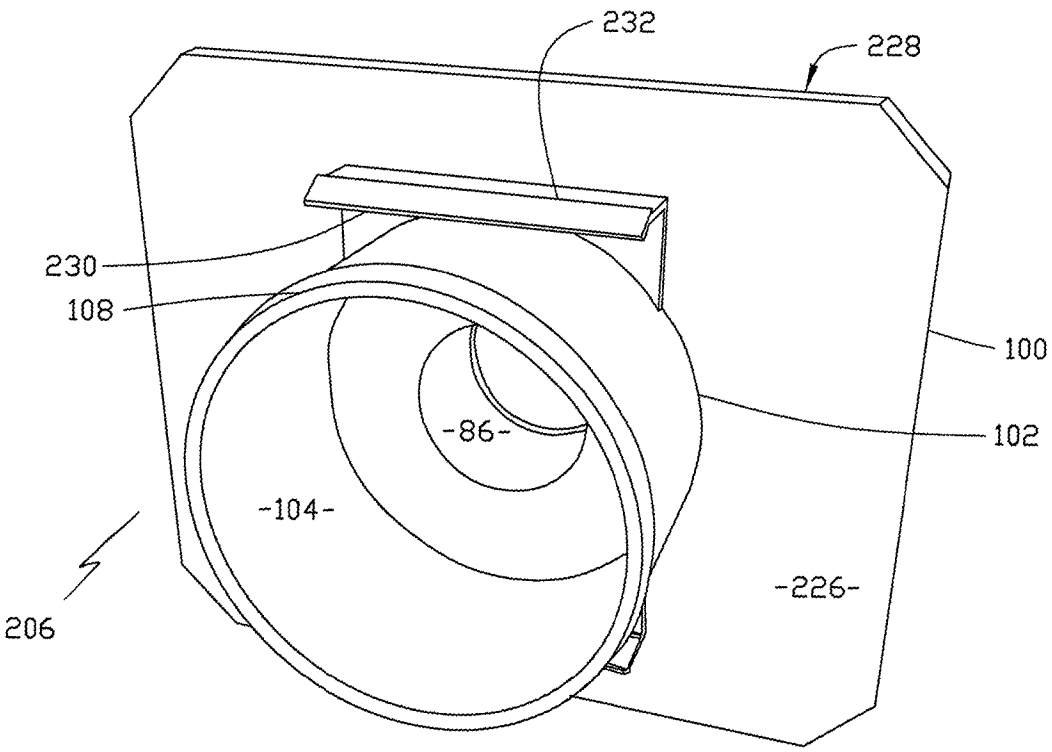
FIG. 14 is a perspective view of a cap that forms part of the connector as shown in FIG. 10.
Figure 15:
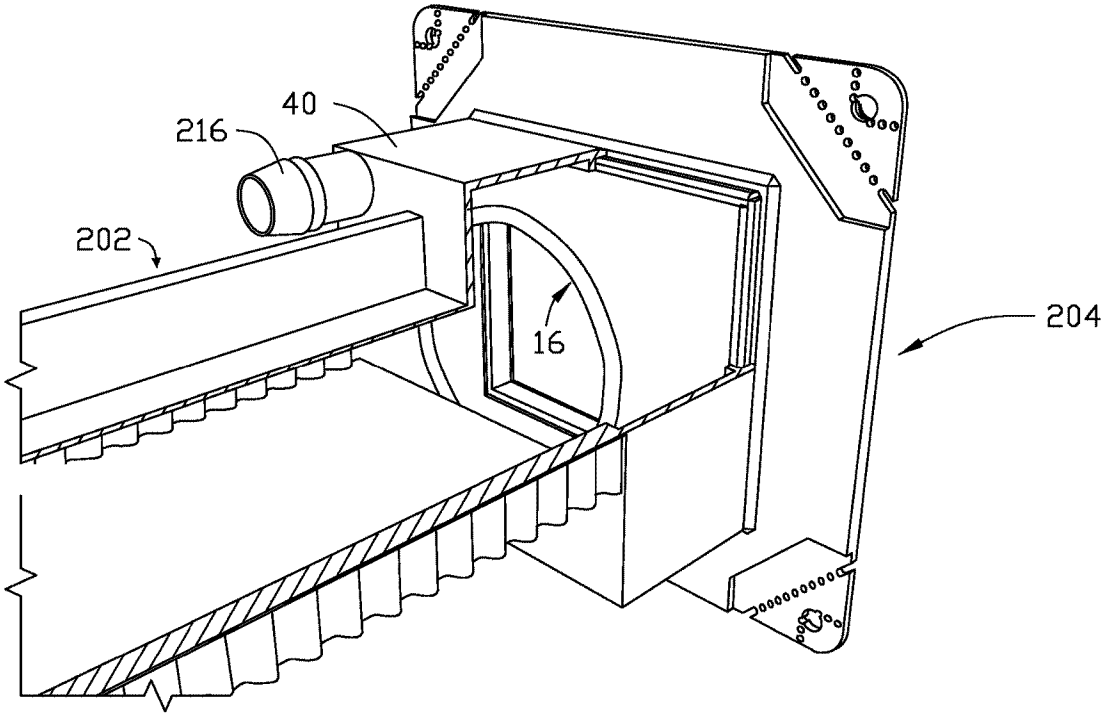
FIG. 15 is a partial cut-away view, shown in perspective, of a partially assembled connector as shown in FIG. 10.

Surrounding the fastening hole 64 at one side of the fastening plate 204 are two spacers 224 as shown in FIG. 13. The purpose of the spacers 224 will be explained later.

Cap 206 comprises a face plate 100 having a mating side 226 and a retaining side 228. Extending from the mating side 226 is a cylindrical male member 102. A locator 86 extends from the retaining side 228.

Surrounding open end 104 of the cylindrical male member 102 is a rim 106. The rim 106 has an inwardly tapering surface 108. Positioned above and below the cylindrical male member 102 are retaining clips 110. Each retaining clip 110 projects from the face plate 100 in a direction substantially parallel to the cylindrical male member 102. Extending from free end 114 of the retaining clip 110 is an angled lip 112. One end 230 of the angled lip 112 is directed towards the cylindrical male member 102. The other end 232 of the angled lip 112 is directed away from the cylindrical male member 102 and towards the mating side 224.

It should be appreciated by the person skilled in the art that, in use, the only differentiation between this second embodiment and the first embodiment essentially relates to the second spigot 216 and its connection by way of grout tubes 128. The provision of the first and second spigot 214, 216 on the sleeve 202 means that the installer can easily determine which spigot 214, 216 is acting as an outlet port for the grout and which spigot 214, 216 is acting as an inlet port for the grout. It also facilitates visual assessment of the grout path across all connectors 200 to ensure that the grout follows a serpentine conduit and thereby picks up all the connectors 200 as described above. This is not possible in the first embodiment, where reliance is placed on memory or contemporaneous records to determine the location of grout tubes 128 once the first slab 20 has been poured.

In accordance with a third embodiment of the invention, where like numerals reference like parts, there is a connector 300 for use in forming a joint between a wall section and a floor section. The connector of this embodiment incorporates the sleeve 202, fastening plate 204, sealing means 16 but in addition incorporates an anchor head 302, a screw fixing 304 and a modified cap 306.

The anchor head 302 comprises a base 308 from which a cylindrical tube 310 extends. The cylindrical tube 310 has an internally threaded portion 312.

The screw fixing 304 comprises a wall plate 314 and a removable cap 316. The wall plate 314 has fastening holes 318 in each corner. An aperture 320 is provided centrally in the wall plate 314 for receiving the removable cap 316. The shape and size of the wall plate 314 are the same as that of face plate 100.

The removable cap 316 has a body 322, a head 324 and a threaded portion 326. The body 322 is of shape and dimension to be received within the aperture 320. The head 324 is larger than the body 322 such that the head 324 prevents the removable cap 316 from passing through the aperture 320.

The threaded portion 326 is of size and dimension so as to allow threaded mating with the internally threaded portion 312 of the cylindrical tube 310.

The modified cap 306 is identical to cap 206 excepting the addition of positioning rim 328. Positioning rim 328 extends around locator 86 at its free end 330.

This embodiment will now be described in the context of its intended use in forming a joint between a wall section (not shown) and a floor section (not shown).

The screw fixing 304 is connected to the anchor head 302 by threadedly mating the internal threaded portion 312 with threaded portion 326. Once connected, the wall plate 314 is fixedly connected to a first piece of formwork (not shown) intended to facilitate the construction of the wall section. This fixed connection is formed by installing the appropriate fastener (not shown) through fastening holes 318. This process is repeated for each desired connector 300 to be installed into the wall section 300.

Once all of the desired mated anchor heads 302 and screw fixings 304 have been fixedly connected, reinforcing mesh (again not shown) may then be installed into the wall void in which the intended wall section is to be formed. Preparatory work is completed by installing a second piece of formwork which effectively defines this wall void.

Concrete is then poured into the defined wall void to create the wall section and allowed to cure. Once cured the first and second piece of formwork are removed.

A third piece of formwork is then installed as would be known to the person skilled in the art to assist in the formation of the floor section. As would be readily understood, the third piece of formwork is positioned below the position of the mated anchor heads 302 and screw fixings 304.

The screw fixing 304 is then removed from the wall section, leaving the anchor head 302 in place. To do this, the removable cap 316 is unthreaded from the anchor head 302 and the wall plate 314 pried loose. This leaves a hole leading to the anchor head 302 and an indentation in the wall section having a profile identical to that of the wall plate 314. It is to be noted that the outer rim diameter of the positioning rim 328 is slightly larger than the void created by the body 322 so as to ensure a sealed tight fit.

Modified cap 306 is then installed into the hole until positioning rim 328 makes contact with the internally threaded portion 312 of the cylindrical tube 310. This should also see face plate 100 neatly received within the indentation left behind by removal of the wall plate 314.

Figure 16:
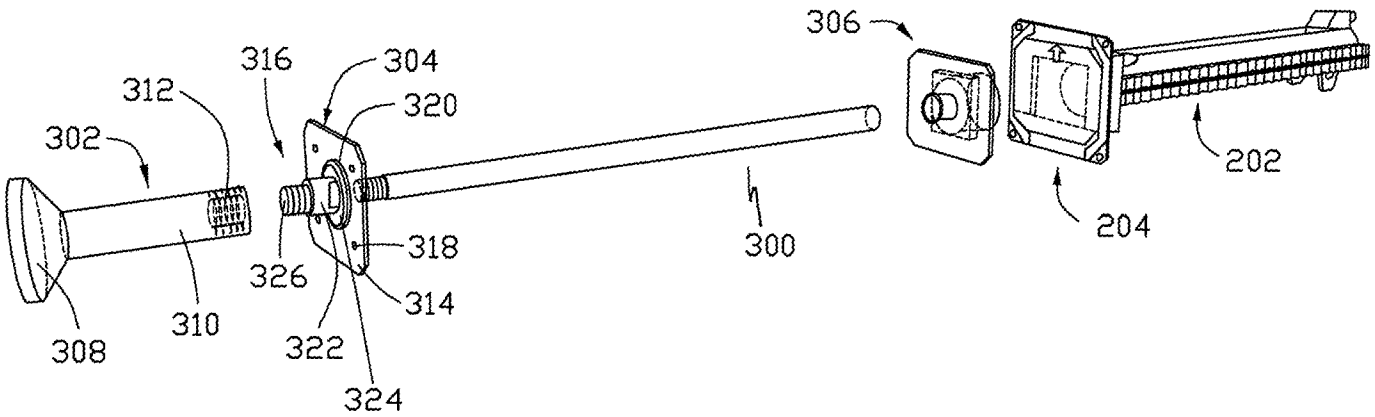
FIG. 16 is an exploded perspective view of a connector according to a third embodiment of the invention.
Figure 17:
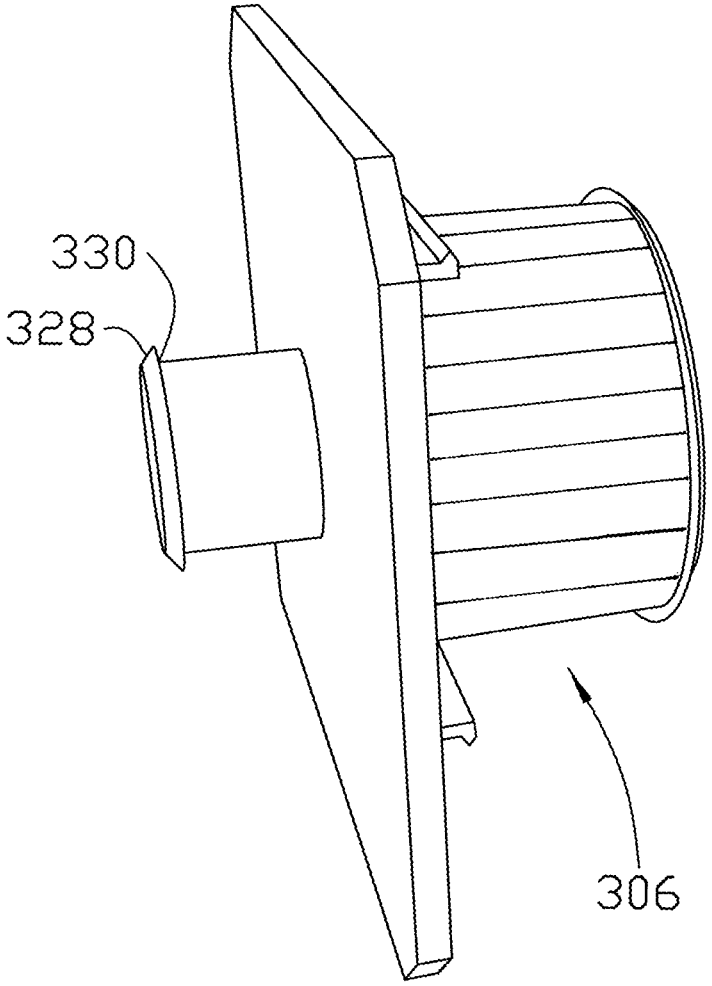
FIG. 17 is a side perspective view of a cap that forms part of the connector as shown in FIG. 16.
Figure 18:
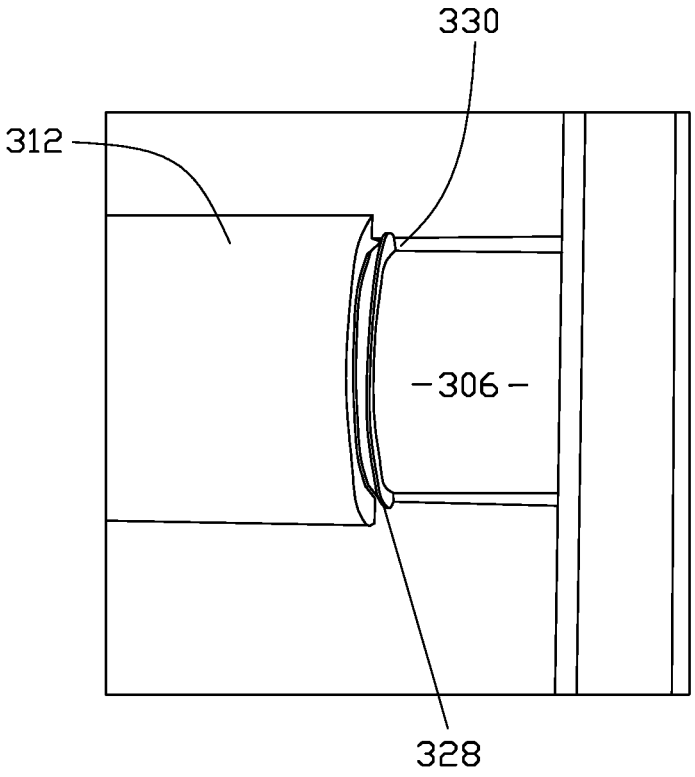
FIG. 18 is a side view of the cap as shown in FIG. 17 as received within a vertical surface.
Figure 19:
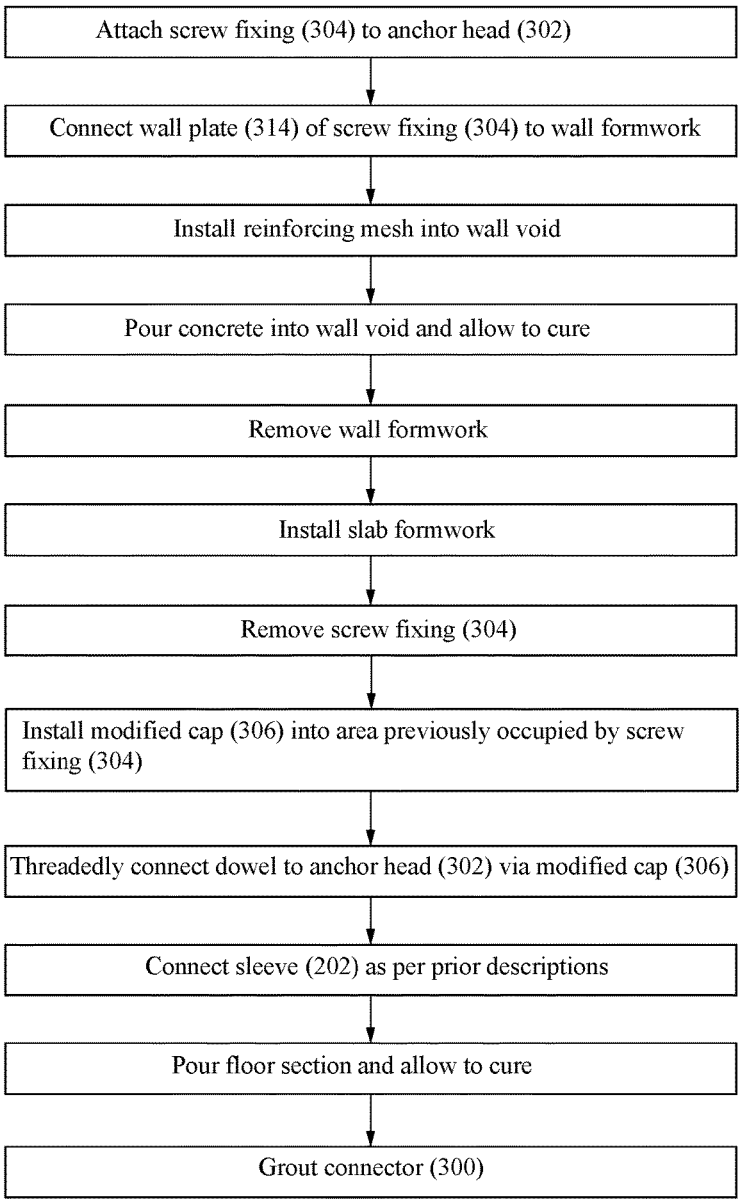
FIG. 19 is a flowchart illustrating the process of installing the connector as shown in FIG. 16 to connect a wall slab to a floor slab.

A dowel having a threaded end as shown in FIG. 16 is then inserted through the cylindrical male member 102 and locator 86. Once so inserted, the dowel may be manipulated as required to threadedly mate the threaded end with the internally threaded portion 312 of cylindrical tube 310. Once threadedly mated, the remainder of the dowel extends out from the modified cap 306 in a direction parallel to the third piece of formwork.

Sleeve 202 is then installed as has already been described in the second embodiment and grout tubes 128 connected as required. Pouring of the floor section and sealing of the sleeve 202 then proceeds as has already been described in the first embodiment.

While the above embodiments have been described with reference to a general form of assembly for the connectors 10, 200, 300, it should be appreciated by the person skilled in the art that other assembly configurations may be used. The only constraint on these assembly configurations is that the cap, must form a fluid tight connection with the sleeve when assembled.

While the above invention has been described in the context of post-tensioned concrete floor slabs, it should be appreciated by the person skilled in the art that the invention is not limited to this use. Rather the invention can be used in relation to any structure, or portion(s) thereof, that utilises PT techniques in its construction. For example, the invention can be used to connect a wall or floor section to a ramp or a wall or floor section to a staircase or a floor to floor slab on ground. In extreme cases the invention can also be used in fibremesh concrete elements as well as reinforced concrete elements.

It should be appreciated by the person skilled in the art that the above invention is not limited to the embodiments described. In particular, the following modifications and improvements may be made without departing from the scope of the present invention:

Ideally, the connector 10, 200, 300 should be of sufficient size to ensure that the reinforcement dowel 34 is surrounded by at least 20 mm of grout along its length.

Figure 20:
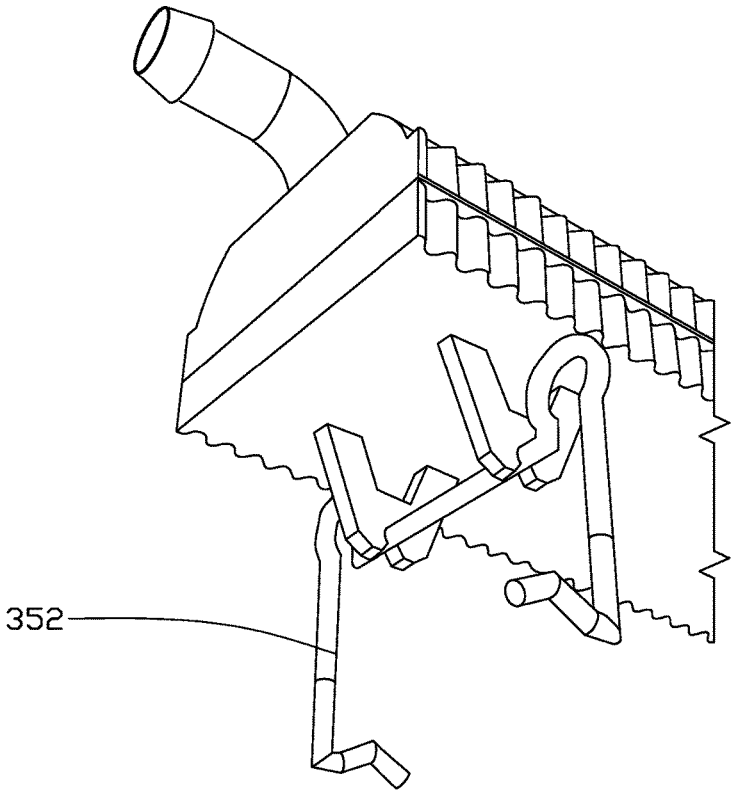
FIG. 20 is a perspective view of a variant of the connector shown in FIG. 1 incorporating means for retaining a chair.

The sleeves 12, 202 may be modified so that a chair 352, as would be readily known to the person skilled in the art, may be releasably attached thereto and provide support for the portion not affixed to formwork 66. An example of such a modification is shown in FIG. 20.

Figure 21:
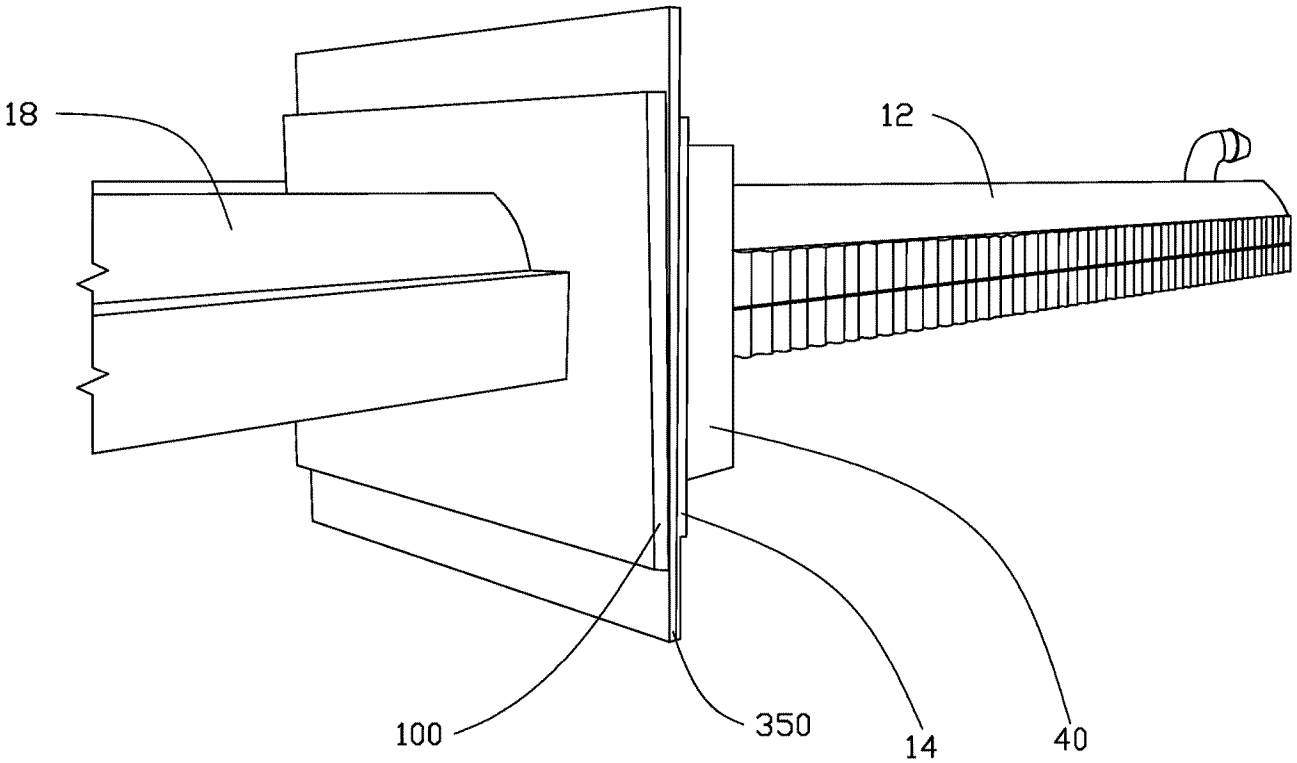
FIG. 21 is a perspective view of an embodiment of the cap and sleeve wherein a compressible material is shown between the face plate and the fastening plate.

To prevent cement fines from entering in the space between the face plate 100 and the fastening plate 14, 204 a compressible material 350 may be applied to either plate 14, 100 as shown in FIG. 21. Ideally, this compressible material has adhesive applied to both of its sides. This facilitates temporary retention of the face plate 100 to the fastening plate 14, 204 until the connector 10, 200 is sealed.

In the first embodiment, ports 48, 90 may take any configuration for a connector 10, provided that one acts as an inlet port for grout while the other acts as an outlet port. An identical consideration applies in respect of the second and third embodiments with regards to spigots 210, 216.

Spacers 224 may be used to compensate for the width of the compressible material as it has been found that without such spacers 224 the fastening of the fastening plate 14, 204 to the formwork makes the frangible sections 218 prone to failure.

Other forms of joining the face plate 100 to the housing 22 are possible. For example, the face plate 100 may be bonded to the housing 22 by use of a suitable adhesive or other bonding agent.

So as to remove the need for cleaning of the open faces 42*a*, a protective cover may be used to protect aperture 58 and open face from dirt or other contaminants. An example of such a protective cover is a removable sticker as shown in FIG. 9-5.

The first and second ports 48, 90 or first and second spigots 210, 216 may be modified as required. Ideally, these components are modified to facilitate quick fit connectors.

The fastening holes 64 may be modified as required to facilitate retention of any suitable fastener, such as nails or screws.

The housing 12 can be of any suitable shape. However, it's preferred form sees the cross-section of the housing 12 as a rounded rectangle or as substantially circular.

The connectors 10, 200, 300 may be made from plastic or other low-cost materials provided that they have sufficient strength to contain the grout and are not prone to damage from installers.

Ribs 38 may be replaced with corrugations, troughs, crests, projections or depressions.

Ribs 28 may have any suitable form, shape, size or profile that increases the contact area between the exterior of the housing 22 and the uncured concrete slab and thus assist in securing in place the sleeve 12.

Other forms of concrete reinforcing may be used such as a grid of rebar.

Rubber extrusion may be made from other material as long as it is flexible.

The first seal 68 may be made of a solid material having a circular rubber profile of 5 mm which is deformed into a shape having a square profile of 4 mm×4 mm when received in square channel 18. In such a configuration, the front ring provides a solid pre-pressurised seal for anchoring the sealing member 16 between the mounting plate 14 and the housing 32.

It should be further appreciated by the person skilled in the art that the invention is not limited to the embodiments described above. Additions or modifications described, where not mutually exclusive, can be combined to form yet further embodiments that are considered to be within the scope of the present invention.

I claim:

1. A connector for use in forming a joint between a first surface and a settled second surface comprising:

a hollow male member having a body wholly embedded in the first surface and an open ended protrusion extending from the body;

a hollow female member to be wholly embedded in the second surface, the female member having a mating opening for receiving the protrusion; and flexible sealing means for forming a fluid tight seal between the female member and male member, where, when installed, a tendon forming part of the first surface is able to extend through the entirety of the male member into the female member and where, prior to grouting, subsequent movement of the male member in any direction caused by the tendon during settling of the first surface is facilitated by the flexibility of the sealing means without breaking the fluid tight seal it forms between the male and female member.

2. A connector for use in forming a joint between a first surface and a second surface according to claim 1, where the flexible sealing means comprises a first seal and a second seal joined by a rubber extrusion and where the first seal is only connected to the female member and the second seal is only connected to the male member.

3. A connector for use in forming a joint between a first surface and a second surface according to claim 2, where the first seal is received within a channel of the female member such that a mechanical seal is formed between the first seal and the channel.

4. A connector for use in forming a joint between a first surface and a second surface according to claim 1, where the open ended protrusion has an inwardly tapering surface, the inwardly tapering surface operable to facilitate connection of the second seal to the open ended protrusion and, when subjected to telescopic movement during settling, operable to prevent disengagement of the second seal from the open ended protrusion.

5. A connector for use in forming a joint between a first surface and a second surface according to claim 1, where either the male member or the female member has a first spigot and second spigot, each configured to receive a grout tube, such that grout pumped through the grout tube connected to the first spigot flows through the connector and exits the connector via the grout tube connected to the second spigot.

6. A connector for use in forming a joint between a first surface and a second surface according to claim 5, where either the male member and/or the female member has at least one lengthwise extending groove provided in the upper surface and the first spigot and second spigot, are positioned higher than the lengthwise extending groove relative to the upper surface of the male and/or female member.

7. A connector for use in forming a joint between a first surface and a second surface according to claim 1, where the mating opening takes the form of a chamber of larger width and height than the remainder of the female member, the protrusion and sealing member being contained within the chamber.

8. A connector for use in forming a joint between a first surface and a second surface according to claim 1, where the female member has a fastening plate for facilitating attachment of the female member to formwork installed to facilitate formation of the second surface.

9. A connector for use in forming a joint between a first surface and a second surface according to claim 8, where the fastening plate has at least one fastening hole for receiving a fastener and thereby facilitating attachment of the female member to the formwork, and where the fastening plate has at least one frangible section, the at least one fastening hole provided in at least one of the at least one frangible sections.

10. A connector for use in forming a joint between a first surface and a second surface according to claim 8, where the male member has a face plate, the face plate having a profile identical to the fastening plate, such that alignment of the face plate with the fastening plate corresponds with alignment of the male member with the female member, and a compressible material, the compressible material being arranged during installation to be positioned between the face plate and the fastening plate.

11. A connector for use in forming a joint between a first surface and a second surface according to claim 1, where the male and/or female member has at least one lengthwise extending groove provided in its upper surface.

12. A connector for use in forming a joint between a settled first surface and a second surface comprising:

a hollow male member having a body wholly embedded in the first surface and an open ended protrusion extending from the body;

a hollow female member to be wholly embedded in the second surface, the female member having a mating opening for receiving the protrusion; and flexible sealing means for forming a fluid tight seal between the female member and male member, where, when installed, a tendon forming part of the second surface is able to extend through the entirety of the female member and thereafter into the protrusion and where, prior to grouting, subsequent movement of the female member in any direction caused by the tendon during settling of the second surface is facilitated by the flexibility of the sealing means without breaking the fluid tight seal it forms between the male and female member.

13. A connector for use in forming a joint between a first surface and a second surface according to claim 12, where the flexible sealing means comprises a first seal and a second seal joined by a rubber extrusion and where the first seal is only connected to the female member and the second seal is only connected to the male member.

14. A connector for use in forming a joint between a first surface and a second surface according to claim 13, where the first seal is received within a channel of the female member such that a mechanical seal is formed between the first seal and the channel.

15. A connector for use in forming a joint between a first surface and a second surface according to claim 12, where the open ended protrusion has an inwardly tapering surface, the inwardly tapering surface operable to facilitate connection of the second seal to the open ended protrusion and, when subjected to telescopic movement during settling, operable to prevent disengagement of the second seal from the open ended protrusion.

16. A connector for use in forming a joint between a first surface and a second surface according to claim 12, where either the male member or the female member has a first spigot and second spigot, each configured to receive a grout tube, such that grout pumped through the grout tube connected to the first spigot flows through the connector and exits the connector via the grout tube connected to the second spigot.

17. A connector for use in forming a joint between a first surface and a second surface according to claim 16, where the male member and/or the female member has at least one lengthwise extending groove provided I its upper surface and the first and second spigot are positioned higher than the lengthwise extending groove relative to the upper surface of the male and/or female member.

18. A connector for use in forming a joint between a first surface and a second surface according to claim 12, where the mating opening takes the form of a chamber of larger width and height than the remainder of the female member, the protrusion and sealing member being contained within the chamber.

19. A connector for use in forming a joint between a first surface and a second surface according to claim 12, where the female member has a fastening plate for facilitating attachment of the female member to formwork installed to facilitate formation of the second surface.

20. A connector for use in forming a joint between a first surface and a second surface according to claim 19, where the fastening plate has at least one fastening hole for receiving a fastener and thereby facilitating attachment of the female member to the formwork, and the fastening plate has at least one frangible section, the at least one fastening hole provided in at least one of the at least one frangible sections.

21. A connector for use in forming a joint between a first surface and a second surface according to claim 19, where the male member has a face plate, the face plate having a profile identical to the fastening plate, such that alignment of the face plate with the fastening plate corresponds with alignment of the male member with the female member, and further comprising a compressible material, the compressible material being arranged during installation to be positioned between the face plate and the fastening plate.

22. A connector for use in forming a joint between a first surface and a second surface according to claim 12, where the male and/or female member has at least one lengthwise extending groove provided in its upper surface.

23. A method of forming a joint between a first surface and a second surface comprising the steps of:

affixing a female member of a connector to formwork for the second surface;

creating the second surface with the female member wholly embedded therein, such that an opening of the female member remains accessible on removal of the formwork;

mating an open ended protrusion extending from a body of a male member of the connector to the opening of the female member following settling of the second surface such that a flexible sealing means forms a fluid tight seal between the female member and the male member;

installing a tendon through the protrusion into the female member; creating the first surface with the body of the male member wholly embedded therein; and grouting the connector where, movement of the body of the male member in any direction caused by the tendon during settling of the first surface is facilitated by the flexibility of the sealing means without breaking the fluid tight seal it forms between the male and female member.

24. A method of forming a joint between a first surface and a second surface according to claim 23, further comprising the step of forming a mechanical seal between the first seal and a channel of the female member, the channel being created by attaching a fastening plate to a chamber forming part of the female member.

25. A method of forming a joint between a first surface and a second surface according to claim 23, further comprising the step of inserting the open ended protrusion through the second seal, such that an inwardly tapering surface of the open ended protrusion facilitates this insertion while, when the male and female members are subjected to telescopic movement during settling, operable to prevent disengagement of the second seal from the open ended protrusion.

26. A method of forming a joint between a first surface and a second surface according to claim 23, further comprising the step of connecting a grout tube to each of a pair of spigots attached to the male member and/or the female member, such that grout pumped through a first spigot flows through the connector and exits the connector via the grout tube connected to a second spigot.

27. A method of forming a joint between a first surface and a second surface according to claim 23, further comprising the step of aligning a fastening plate of the female member to a face plate of the male member.

28. A method of forming a joint between a first surface and a second surface according to claim 27, further comprising the step of installing a compressible material between the face plate and the fastening plate, and further comprising the step of creating a bond between the compressible material and the at least one of the face plate, the fastening plate and any combination thereof.

29. A method of forming a joint between a first surface and a second surface comprising the steps of:

affixing a female member of a connector to formwork for the second surface;

creating the second surface with the female member wholly embedded therein, such that an opening of the female member remains accessible on removal of the formwork;

installing a tendon such that it extends entirely through the female member;

mating an open ended protrusion extending from a body of a male member of the connector to the opening of the female member following settling of the second surface such that a flexible sealing means forms a fluid tight seal between the female member and the male member and the tendon is received within the open ended protrusion;

creating the first surface with the body of the male member wholly embedded therein; and grouting the connector where, movement of the body of the male member in any direction caused by the tendon during settling of the first surface is facilitated by the flexibility of the sealing means without breaking the fluid tight seal it forms between the male and female member.

30. A method of forming a joint between a first surface and a second surface according to claim 29, further comprising the step of forming a mechanical seal between the first seal and a channel of the female member, the channel being formed by attaching a fastening plate to a chamber forming part of the female member.

31. A method of forming a joint between a first surface and a second surface according to claim 29, further comprising the step of inserting the open ended protrusion through the second seal, such that an inwardly tapering surface of the open ended protrusion facilitates this insertion while, when the male and female members are subjected to telescopic movement during settling, operable to prevent disengagement of the second seal from the open ended protrusion.

32. A method of forming a joint between a first surface and a second surface according to claim 29, further comprising the step of connecting a grout tube to each of a pair of spigots attached to the male member and/or the female member, such that grout pumped through a first spigot flows through the connector and exits the connector via the grout tube connected to a second spigot.

33. A method of forming a joint between a first surface and a second surface according to claim 29, further comprising the step of aligning a fastening plate of the female member to a face plate of the male member and installing a compressible material between the face plate and the fastening plate and further including the step of creating a bond between the compressible material and at least one of the face plate, the fastening plate and any combination thereof.

34. A connection set for forming a joint between a vertical surface and a horizontal surface, the connection set comprising:

an anchor head for embedding in the vertical surface, the anchor head having a threaded portion;

a dowel having a mating threaded portion;

a hollow male member to be received in the vertical surface, the male member having an open ended protrusion extending therefrom and an open ended body;

a hollow female member to be embedded in the horizontal surface, the female member having a mating opening for receiving the protrusion; and flexible sealing means for forming a fluid tight seal between the female member and male member, where, when installed, the dowel is matedly connected to the anchor head by way of the threaded portions and unmated end of the dowel extends through the protrusion into the female member such that, prior to grouting, movement of the female member in any direction caused by the dowel during settling of the horizontal surface is facilitated by the flexibility of the sealing means without breaking the fluid tight seal it forms between the male and female member.

35. A connection set for forming a joint between a vertical surface and a horizontal surface according to claim 34, further comprising a wall plate, the wall plate having a cylinder having a threaded portion, the cylinder operable to matedly connect to the anchor head by way of the threaded portions, and thereby retain the anchor head in place during creation of the vertical surface.

36. A method of forming a joint between a vertical surface and a horizontal surface comprising the steps of:

fastening a wall plate to formwork for the creation of the vertical surface; connecting an anchor head to a cylinder portion of the wall plate;

forming the vertical surface with the anchor head and wall plate formed therein;

removing the wall plate from the vertical surface;

connecting a dowel to the anchor head embedded in the vertical surface; installing a male member into the area formed by the removal of the wall plate from the vertical surface, the male member having an open ended protrusion through which the dowel extends;

mating the open ended protrusion of the male member to an opening of a female member, such that a flexible sealing means forms a fluid tight seal between the female member and the male member;

creating the horizontal surface with the female member embedded therein; and grouting the connector.

37. A method of forming a joint between a vertical surface and a horizontal surface according to claim 36, further comprising the step of forming a mechanical seal between the first seal and a channel of the female member, and further comprising the step of creating the channel by attaching a fastening plate to a chamber forming part of the female member.

38. A method of forming a joint between a vertical surface and a horizontal surface according to claim 37, further comprising the step of inserting the open ended protrusion through the second seal, such that an inwardly tapering surface of the open ended protrusion facilitates this insertion while, when the male and female members are subjected to telescopic movement during settling, operable to prevent disengagement of the second seal from the open ended protrusion.

39. A method of forming a joint between a vertical surface and a horizontal surface according to claim 37, further comprising the step of connecting a grout tube to each of a pair of spigots attached to the female member, such that grout pumped through a first spigot flows through the connector and exits the connector via the grout tube connected to a second spigot.

40. A method of forming a joint between a vertical surface and a horizontal surface according to claim 37, further comprising the step of aligning a fastening plate of the female member to a face plate of the male member, and installing a compressible material between the face plate and the fastening plate, the method further including the step of creating a bond between the compressible material and at least one of the face plate, the fastening plate and any combination thereof.

* * * * *